US011303032B2

(12) United States Patent
Jo et al.

(10) Patent No.: US 11,303,032 B2
(45) Date of Patent: Apr. 12, 2022

(54) ELECTRONIC DEVICE COMPRISING ANTENNA

(71) Applicant: SAMSUNG ELECTRONICS CO., LTD., Suwon-si (KR)

(72) Inventors: Jae Hoon Jo, Suwon-si (KR); Su Min Yun, Suwon-si (KR); Myung Hun Jeong, Suwon-si (KR); Je Hun Jong, Suwon-si (KR); Se Hyun Park, Suwon-si (KR); Jae Bong Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 372 days.

(21) Appl. No.: 16/199,855

(22) Filed: Nov. 26, 2018

(65) Prior Publication Data

US 2019/0165478 A1 May 30, 2019

(30) Foreign Application Priority Data

Nov. 28, 2017 (KR) ..... 10-2017-0160837

(51) Int. Cl.
*H01Q 9/28* (2006.01)
*H01Q 19/24* (2006.01)
(Continued)

(52) U.S. Cl.
CPC ..... *H01Q 9/285* (2013.01); *H01Q 1/2283* (2013.01); *H01Q 1/243* (2013.01); *H01Q 3/24* (2013.01);
(Continued)

(58) Field of Classification Search
CPC ..... H01Q 9/285; H01Q 1/2283; H01Q 19/30; H01Q 1/243; H01Q 21/24; H01Q 19/24;
(Continued)

(56) References Cited

U.S. PATENT DOCUMENTS 7,253,779 B2 8/2007 Greer et al.
7,656,360 B2 2/2010 Hirabayashi
(Continued)

FOREIGN PATENT DOCUMENTS

CN 101971519 2/2011
CN 104106180 10/2014
(Continued)

OTHER PUBLICATIONS

Extended European Search Report and Written Opinion dated Aug. 11, 2020 in corresponding European Patent Application No. 18883445.1.
(Continued)

*Primary Examiner* — Dimary S Lopez Cruz
*Assistant Examiner* — Michael M Bouizza
(74) *Attorney, Agent, or Firm* — Nixon & Vanderhye, P.C.

(57) ABSTRACT

An electronic device includes a first conductive plate, a second conductive plate that is spaced from the first conductive plate and is disposed parallel to the first conductive plate, a conductive element that is disposed in a space between the first conductive plate and the second conductive plate, a wireless communication circuit that is electrically connected with the first conductive plate and the conductive element, and a printed circuit board that is coupled with at least one side of the first conductive plate, at least one side of the second conductive plate, and one end of the conductive element. The wireless communication circuit is configured to transmit/receive a first radio frequency (RF) signal having a vertical polarization characteristic using the first conductive plate and the second conductive plate and to transmit/receive a second RF signal having a horizontal polarization characteristic using the conductive element.

14 Claims, 16 Drawing Sheets

(51) Int. Cl.

| | |
|---|---|
| ***H01Q 21/06*** | (2006.01) |
| ***H01Q 21/24*** | (2006.01) |
| ***H01Q 3/24*** | (2006.01) |
| ***H01Q 1/22*** | (2006.01) |
| ***H01Q 19/30*** | (2006.01) |
| ***H01Q 1/24*** | (2006.01) |

(52) U.S. Cl.
CPC ..... *H01Q 19/24* (2013.01); *H01Q 19/30* (2013.01); *H01Q 21/062* (2013.01); *H01Q 21/24* (2013.01); *H01Q 21/245* (2013.01)

(58) Field of Classification Search
CPC ..... H01Q 3/24; H01Q 21/245; H01Q 21/062; H01Q 21/065; H01Q 1/2208; H01Q 1/38; H01Q 1/46; H04M 1/0249; H04M 1/0277
See application file for complete search history.

(56) References Cited

U.S. PATENT DOCUMENTS

| | | | | |
|---|---|---|---|---|
| 8,009,102 | B2 | 8/2011 | Kim et al. | |
| 8,354,972 | B2 | 1/2013 | Borja et al. | |
| 9,525,208 | B2 | 12/2016 | Chen et al. | |
| 9,653,818 | B2 | 5/2017 | Mohammadian et al. | |
| 9,666,954 | B2 | 5/2017 | Ko et al. | |
| 9,871,297 | B2 | 1/2018 | Kitchener | |
| 9,923,261 | B2 | 3/2018 | Jin et al. | |
| 10,381,736 | B2 | 8/2019 | Jung et al. | |
| 10,432,290 | B2 | 10/2019 | Luo et al. | |
| 2007/0001924 | A1 | 1/2007 | Hirabayashi | |
| 2009/0231225 | A1 | 9/2009 | Choudhury et al. | |
| 2010/0171675 | A1 | 7/2010 | Borja et al. | |
| 2010/0304785 | A1 | 12/2010 | Marlett et al. | |
| 2011/0014878 | A1 | 1/2011 | Choudhury et al. | |
| 2013/0050056 | A1* | 2/2013 | Lee | H01Q 1/243 343/893 |
| 2013/0147664 | A1 | 6/2013 | Lin | |
| 2015/0048989 | A1 | 2/2015 | Chen et al. | |
| 2016/0043470 | A1 | 2/2016 | Ko et al. | |
| 2016/0049723 | A1* | 2/2016 | Baks | H01Q 21/065 343/848 |
| 2016/0087348 | A1 | 3/2016 | Ko et al. | |
| 2016/0181703 | A1 | 6/2016 | Choudhury et al. | |
| 2016/0248169 | A1 | 8/2016 | Mohammadian et al. | |
| 2017/0012359 | A1 | 1/2017 | Jung et al. | |
| 2017/0237154 | A1 | 8/2017 | Choudhury et al. | |
| 2017/0294705 | A1 | 10/2017 | Khripkov et al. | |
| 2019/0140343 | A1 | 5/2019 | Choudhury et al. | |
| 2020/0161745 | A1 | 5/2020 | Khripkov et al. | |

FOREIGN PATENT DOCUMENTS

| | | |
|---|---|---|
| CN | 105990652 | 10/2016 |
| CN | 106030905 | 10/2016 |
| KR | 10-2017-0101310 | 9/2017 |
| WO | 2016043450 | 3/2016 |
| WO | 2017/025116 | 2/2017 |

OTHER PUBLICATIONS

International Search Report and Written Opinion dated Feb. 25, 2019 in counterpart International Patent Application No. PCT/KR2018/014330.

Office Action dated Nov. 19, 2020 in counterpart Chinese Application No. 201880076661.9.

Notice of Allowance dated Aug. 5, 2021 in counterpart Chinese Application No. 201880076661.9 and English-language translation.

Notification of Reason for Refusal dated Sep. 15, 2021 in counterpart Korean Application No. 10-2017-0160837 and English-language translation.

* cited by examiner

400

100

ELECTRONIC DEVICE COMPRISING ANTENNA

CROSS-REFERENCE TO RELATED APPLICATION

This application is based on and claims priority under 35 U.S.C. § 119 to Korean Patent Application No. 10-2017-0160837, filed on Nov. 28, 2017, in the Korean Intellectual Property Office, the disclosure of which is incorporated by reference herein its entirety.

BACKGROUND

1. Field

The present disclosure relates to an electronic device including an antenna.

2. Description of Related Art

As the mobile traffic sharply increases, a 5th generation (5G) mobile communication technology based on a ultra-high-band frequency of 20 GHz or higher is being developed. An ultra-high-band frequency signal includes a millimeter wave (mmWave) having a frequency band ranging from 20 GHz to 100 GHz. If the ultra-high-band frequency is used, a wavelength may become short, and thus, an antenna and a device may become small-sized and/or lightweight. Also, the short wavelength may make it possible to mount relatively many antennas in the same area, and thus, a signal may be transmitted intensively in a specific direction. Also, since the bandwidth may be used more widely, a significant amount of information may be transmitted.

The above information is presented as background information only to assist with an understanding of the present disclosure. No determination has been made, and no assertion is made, as to whether any of the above might be applicable as prior art with regard to the present disclosure.

An electronic device may include a dual polarized antenna in a communication device for providing a 5G communication service. The dual polarized antenna may include an antenna for vertical polarization or an antenna for horizontal polarization.

To implement the dual polarized antenna, a space for an antenna for vertical polarization and a space for an antenna for horizontal polarization may be respectively required. Since an antenna for 5G communication is mounted in the form of an array, a larger space may be required.

SUMMARY

Aspects of the present disclosure address at least the above-mentioned problems and/or disadvantages and provide at least the advantages described below. Accordingly, an aspect of the present disclosure is to provide a method for mounting a plurality of antennas on an electronic device.

In accordance with an aspect of the present disclosure, an electronic device may include a first conductive plate, a second conductive plate that is spaced from the first conductive plate and is positioned parallel to the first conductive plate, a conductive element that is positioned in a space between the first conductive plate and the second conductive plate, a wireless communication circuit that is electrically connected with the first conductive plate and the conductive element, and a printed circuit board that is coupled with at least one side of the first conductive plate, at least one side of the second conductive plate, and one end of the conductive element. The wireless communication circuit may transmit/receive a first radio frequency (RF) signal having a vertical polarization characteristic using the first conductive plate and the second conductive plate and may transmit/receive a second RF signal having a horizontal polarization characteristic using the conductive element.

In accordance with another aspect of the present disclosure, an electronic device may include a housing that includes a front plate, a back plate facing a direction opposite the front plate, and a side portion surrounding a space between the front plate and the back plate, a touch-screen display exposed through the front plate, an antenna array disposed in the space, wherein the antenna array includes at least one group including a first conductive plate disposed parallel to the back plate and spaced from the back plate by a first distance, a pair of conductive elements spaced from the first conductive plate when viewed from above the back plate and disposed parallel to the back plate, wherein the pair of conductive elements includes a first conductive element spaced from the back plate by a second distance greater than the first distance, and a second conductive element spaced from the back plate by the second distance or a third distance greater than the second distance, and a second conductive plate interposed between the first conductive plate and the front plate, disposed parallel to the back plate, and spaced from the back plate by a fourth distance greater than the third distance, a wireless communication circuit electrically connected with the first conductive plate and the first conductive element or the second conductive element, and a processor electrically connected to the display and the wireless communication circuit. The wireless communication circuit may transmit/receive a signal in a frequency band of 20 GHz or higher.

According to various example embodiments of the present disclosure, a space occupied by an antenna may decrease by making spaces for mounting a plurality of antennas overlap each other at least partially.

A variety of effects directly or indirectly understood through this disclosure may be provided.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description, taken in conjunction with the accompanying drawings, in which.

DETAILED DESCRIPTION

Hereinafter, various example embodiments of the present disclosure will be described with reference to accompanying drawings. However, those of ordinary skill in the art will recognize that various modifications, equivalents, and/or alternatives of the various example embodiments described herein can be made without departing from the scope and spirit of the present disclosure.

Figure 1A:
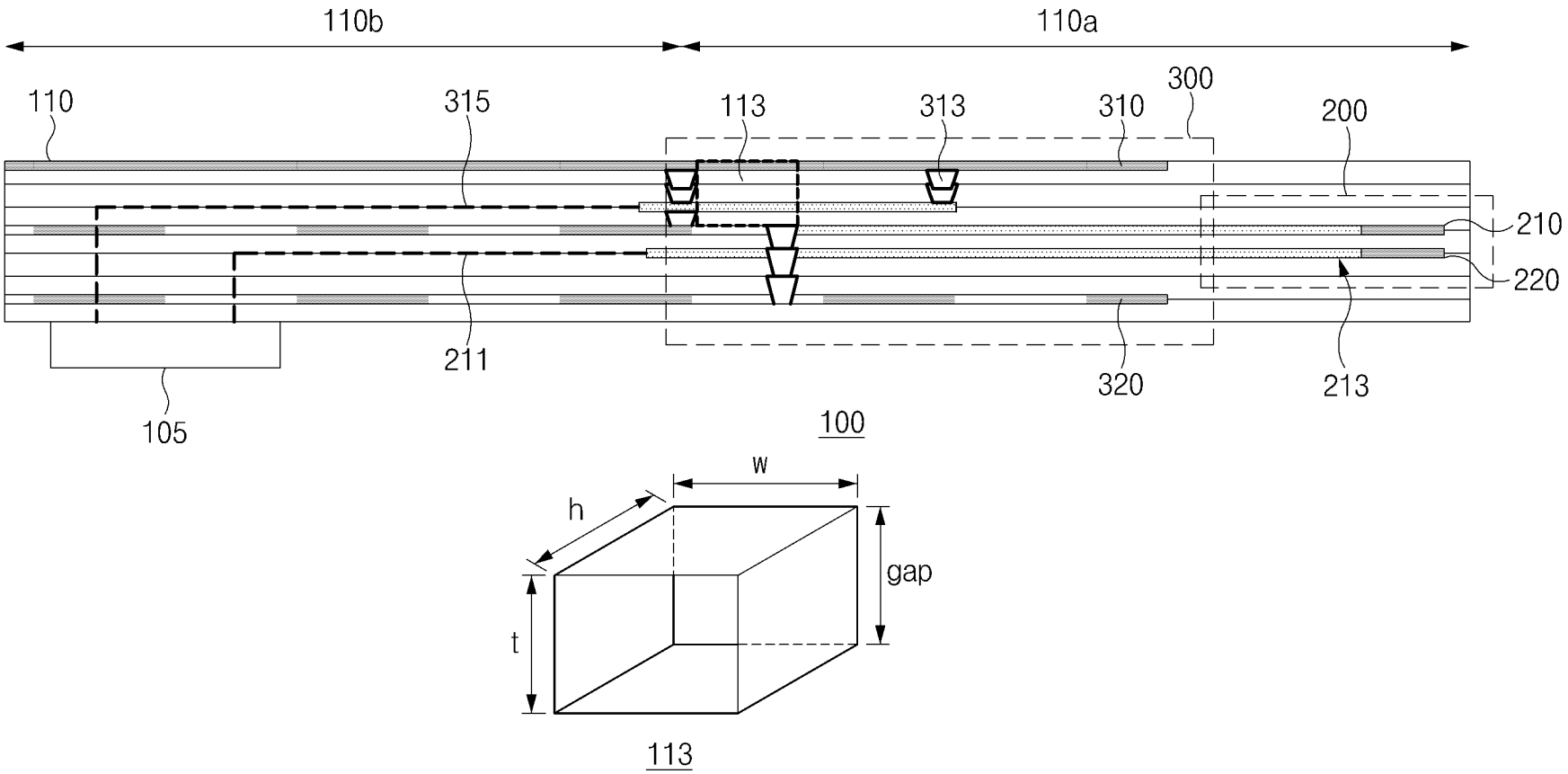
FIG. 1A is a sectional view illustrating an electronic device including an antenna according to an embodiment.

FIG. 1A is a sectional view illustrating an electronic device including an antenna according to an embodiment.

Referring to FIG. 1A, an electronic device 100 according to an embodiment may include a first antenna 300 for vertical polarization and a second antenna 200 for horizontal polarization. For example, the first antenna 300 may include a first antenna element 310 and a second antenna element 320. For example, the second antenna 200 may include at least one antenna element. The second antenna 200 including the third antenna element 210 and the fourth antenna element 220 is illustrated in FIG. 1A.

In various embodiments, the first antenna element 310 and the second antenna element 320 may, for example, be referred to as a "conductive plate". The third antenna element 210 and the fourth antenna element 220 may, for example, be referred to as a "conductive element" (e.g., a conductive pattern).

In various embodiments, the electronic device 100 may include a first antenna array including a plurality of first antennas 300 and a second antenna array including a plurality of second antennas 200. For example, the first antenna array may be referred to as a "vertically polarized antenna array", a second antenna array may be referred to as a "horizontally polarized antenna", and a wireless communication circuit may be referred to as a "array module" (e.g., an array module 500 of FIG. 8A) or a "communication device" (e.g., a communication device 600 of FIG. 8B or a communication device 921, 922, 923, or 924). Embodiments associated with the above description will be described in greater detail below with reference to FIGS. 8A, 8B and to 8C.

In an embodiment, the first antenna element 310 may be spaced from the second antenna element 320 and may be positioned parallel to the second antenna element 320. The second antenna 200 may be positioned in a space between the first antenna element 310 and the second antenna element 320.

In an embodiment, the electronic device 100 may include a printed circuit board 110. For example, the printed circuit board 110 may be referred to as a "PCB". In various embodiments, the printed circuit board 110 may include the first antenna 300 and the second antenna 200. For example, the first antenna element 310, the second antenna element 320, the third antenna element 210, and the fourth antenna element 220 may comprise a conductive plate or a conductive pattern on the printed circuit board 110. Alternatively, the printed circuit board 110 may support the first antenna element 310, the second antenna element 320, the third antenna element 210, and the fourth antenna element 220 implemented with separate conductive patterns.

In an embodiment, at least one side of the first antenna element 310, at least one side of the second antenna element 320, and one end of the second antenna 200 may be supported by the printed circuit board 110.

In an embodiment, the electronic device 100 may include a wireless communication circuit 105 electrically connected to the first antenna element 310 and the second antenna 200. The wireless communication circuit 105 may include, for example, a communication processor.

In an embodiment, the wireless communication circuit 105 may transmit/receive an RF signal of a vertical polarization characteristic using the first antenna 300. For example, the wireless communication circuit 105 may apply the RF signal to the first antenna 300 through a first feed part 313.

In an embodiment, the wireless communication circuit 105 may feed the first antenna element 310 through the first feed part 313 included in the first antenna element 310. The first feed part 313 may be electrically connected with the wireless communication circuit 105 through a first feed line 315. The second antenna element 320 may be electrically connected with a ground region of the printed circuit board 110. In various embodiments, the first antenna 300 may function as a patch antenna.

In various embodiments, the printed circuit board 110 may include a cavity 113 for impedance matching. The cavity 113 may be referred to as a "matching region" for impedance matching of the first antenna 300. For example, the cavity 113 may be referred to as an "empty space" which has a transverse length "w", a longitudinal length "h", and a height length "h". The transverse length "w", the longitudinal length "h", and the height length "h" may be associated with impedance matching.

For example, an inductance and a capacitance which are determined by the transverse length "w", the longitudinal length "h", and the height length "h" of the cavity 113 may be utilized for impedance matching with regard to the first antenna 300. For example, the cavity 113 may be used as a matching circuit.

In an embodiment, the wireless communication circuit 105 may transmit/receive an RF signal of a horizontal polarization characteristic using the second antenna 200. For example, the wireless communication circuit 105 may apply the RF signal to the second antenna 200 through a second feed part 213.

In an embodiment, the wireless communication circuit 105 may feed the second antenna 200 through the second feed part 213 of the second antenna 200. The second feed part 213 may be electrically connected with the wireless communication circuit 105 through a second feed line 211. In various embodiments, the second antenna 200 may function as a dipole antenna.

In various embodiments, the second antenna 200 may have one feed part (a single feed structure) or may have two feed parts (a dual feed structure). For example, a feed structure associated with the dipole antenna will be described in greater detail below with reference to FIG. 3.

In various embodiments, the second antenna 200 may include one or two conductive elements. A conductive element may function as a radiator of the dipole antenna. Various structures of the dipole antenna will be described in greater detail below with reference to FIG. 3.

In various embodiments, the printed circuit board 110 may include a first region 110*a* where the first antenna 300 and the second antenna 200 are positioned, and a second region 110*b* being the remaining region other than the first region 110*b*.

For example, the first region 110*a* may comprise a non-conductive material. The second region 110*b* may include a feed network. In the case where the plurality of first antennas 300 and the plurality of second antennas 200 are mounted, a plurality of feed lines which are extended from the wireless communication circuit 105 and may be connected to the plurality of antennas 200 and 300 may be arranged in the second region 110*b*.

For example, the second region 110*b* may include a ground layer. The second antenna element 320 and the fourth antenna element 220 extend from the ground layer.

In an embodiment, the second antenna 200 may include the third antenna element 210 or the fourth antenna element 220. For example, a dipole antenna including two antenna elements is illustrated in FIG. 1A.

In an embodiment, the second feed part 213 may be positioned at the third antenna element 210. One end of the fourth antenna element 220 may be electrically connected with a ground region of the printed circuit board 110.

In various embodiments, the wireless communication circuit 105 may transmit/receive a millimeter wave (mm-Wave) having a frequency of 20 GHz or higher depending on a vertical, horizontal transmit/receive control signal under control of a processor (e.g., a processor 940 of FIG. 9) of the electronic device 100.

Figure 1B:
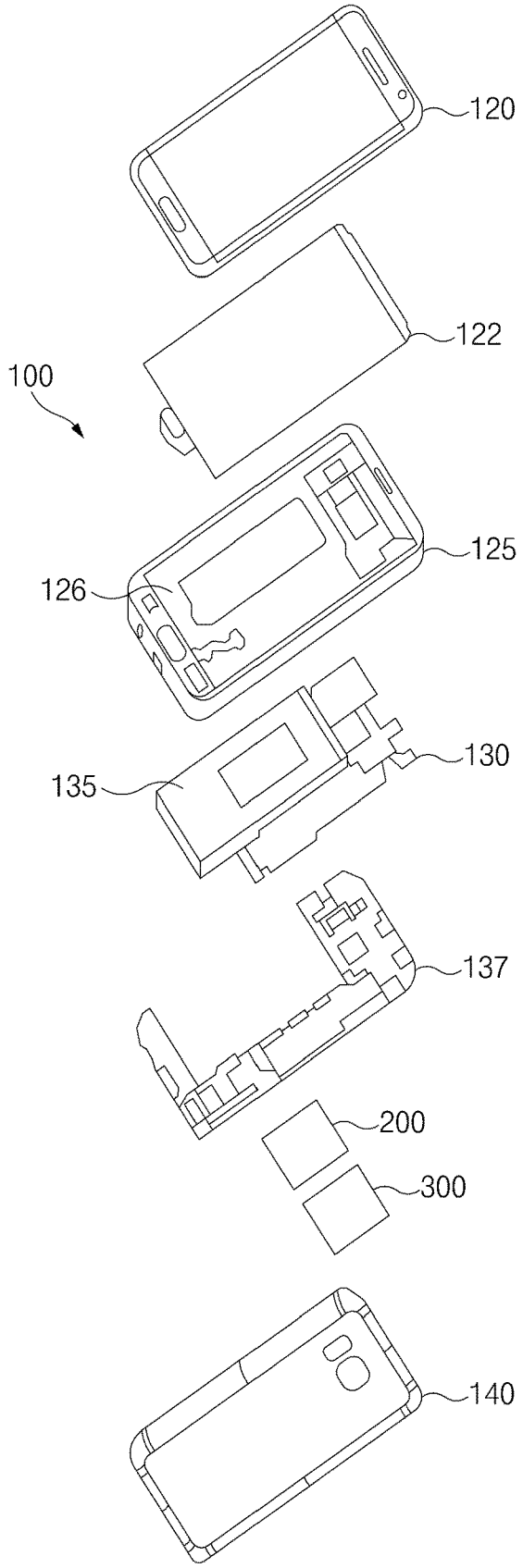
FIG. 1B is an exploded perspective view illustrating an electronic device including an antenna according to an embodiment.

FIG. 1B is an exploded perspective view illustrating an electronic device including an antenna according to an embodiment.

Referring to FIG. 1B, the electronic device 100 may include a front plate 120, a display 122 (e.g., a touchscreen display), a side member (e.g., side portion) 125, a first support member 126 (e.g., a bracket), a substrate 130, a battery 135, a second support member 137 (e.g., a rear case), and a back plate 140. In any embodiment, the electronic device 100 may not include at least one (e.g., the first support member 126 or the second support member 137) of the components or may further include any other component.

In an embodiment, a housing of the electronic device 100 may include the front plate 120, the back plate 140 facing away from (e.g., a direction opposite) the front plate 120, and the side member (e.g., a side portion) 125 surrounding a space between the front plate 120 and the back plate 140. A portion of the display 122 may be exposed through the front plate 120.

In an embodiment, the first support member 126 may be positioned within the electronic device 100 and may be connected with the side member 125, or may be integrally formed with the side member 125. The first support member 126 may comprise, for example, a metal material and/or a nonmetal material (e.g., polymer). The display 122 may be coupled with one surface of the first support member 126, and the substrate 130 may be coupled with an opposite surface of the substrate 130. For example, the substrate 130 may be referred to as a "main PCB". A processor, a memory, and/or an interface may be mounted on the substrate 130. According to an embodiment, the substrate 130 may be a printed circuit board (PCB). For example, the processor may include one or more of a central processing unit, an application processor, a graphic processing device, an image signal processor, a sensor hub processor, a communication processor, or the like, but is not limited thereto.

The interface may include, for example, a high definition multimedia interface (HDMI), a universal serial bus (USB) interface, a secure digital (SD) card interface, and/or an audio interface, or the like, but is not limited thereto. The interface may electrically or physically connect, for example, the electronic device 100 with an external electronic device and may include a USB connector, an SD card/MMC connector, an audio connector, or the like.

The battery 135 which may supply power to at least one component of the electronic device 100 may include, for example, a primary cell incapable of being recharged, a secondary cell rechargeable, a fuel cell, or the like, but is not limited thereto. At least a part of the battery 135 may be positioned on substantially the same plane as the printed circuit board 130, for example. The battery 135 may be integrally positioned within the electronic device 100, or may be positioned to be removable from the electronic device 100.

In an embodiment, the first antenna 300 and the second antenna 200 may be interposed between the second support member 137 and the back plate 140. For example, the first antenna 300 and the second antenna 200 may be electrically connected with the substrate 130.

In various embodiments, the first antenna element 310 and the second antenna element 320 of the first antenna 300 may be positioned parallel to the front plate 120 and the back plate 140. The first antenna element 310 may be spaced from the back plate 140 by as much as a first distance. The second antenna element 320 may be interposed between the first antenna element 310 and the front plate 120. The second antenna element 320 may be spaced from the back plate 140 by as much as a second distance larger than the first distance.

In various embodiments, the third antenna element 210 and the fourth antenna element 220 of the second antenna 200 may be positioned in a space between the first antenna element 310 and the second antenna element 320. For example, in the case where the second antenna includes two conductive elements, the two conductive elements may be spaced from the back plate 140 by as much as the same distance and may be positioned parallel to each other. Alternatively, the two conductive elements may be spaced from the back plate 140 by as much as different distances and may be positioned to be out of line.

Figure 2A:
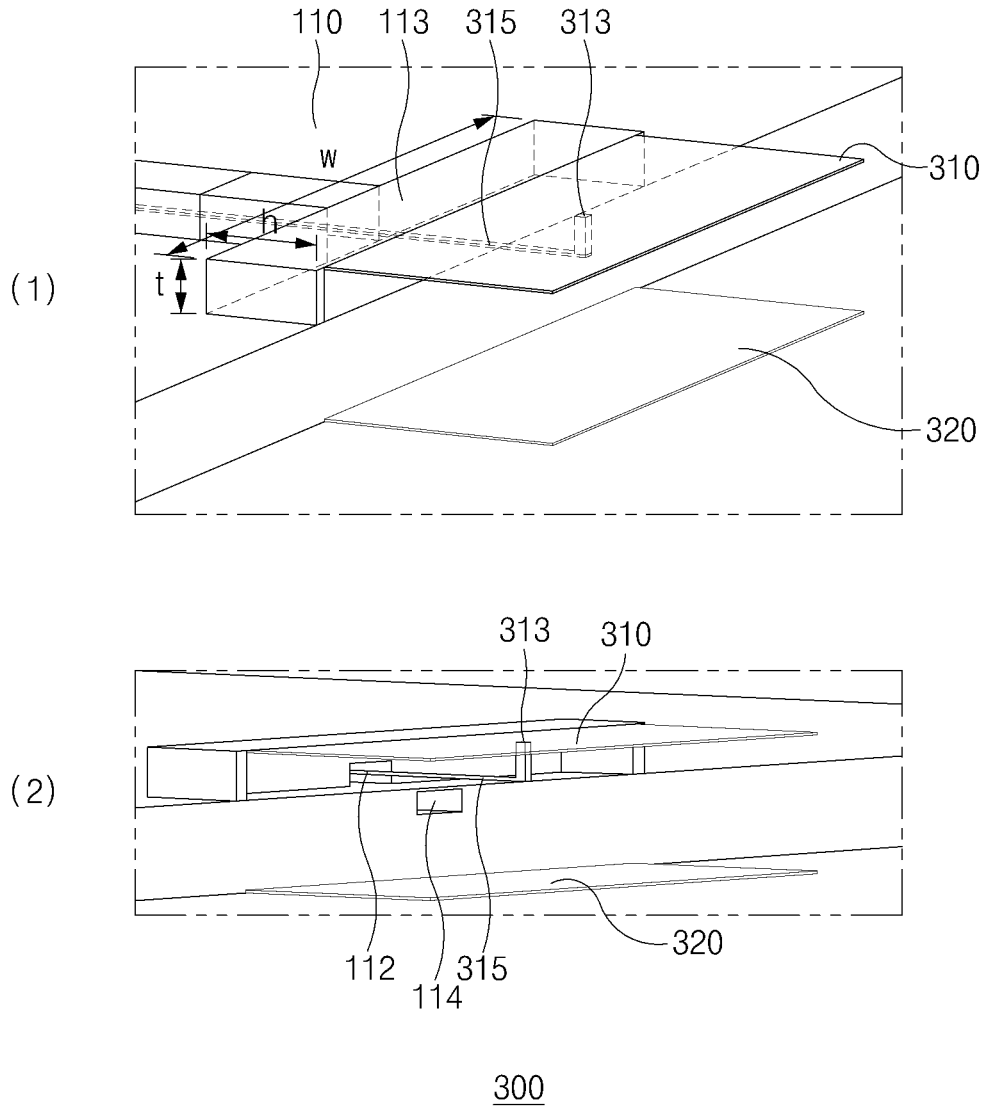
FIGS. 2A, 2B and 2C are perspective views illustrating an electronic device including a first antenna and a second antenna according to an embodiment.
Figure 2B:
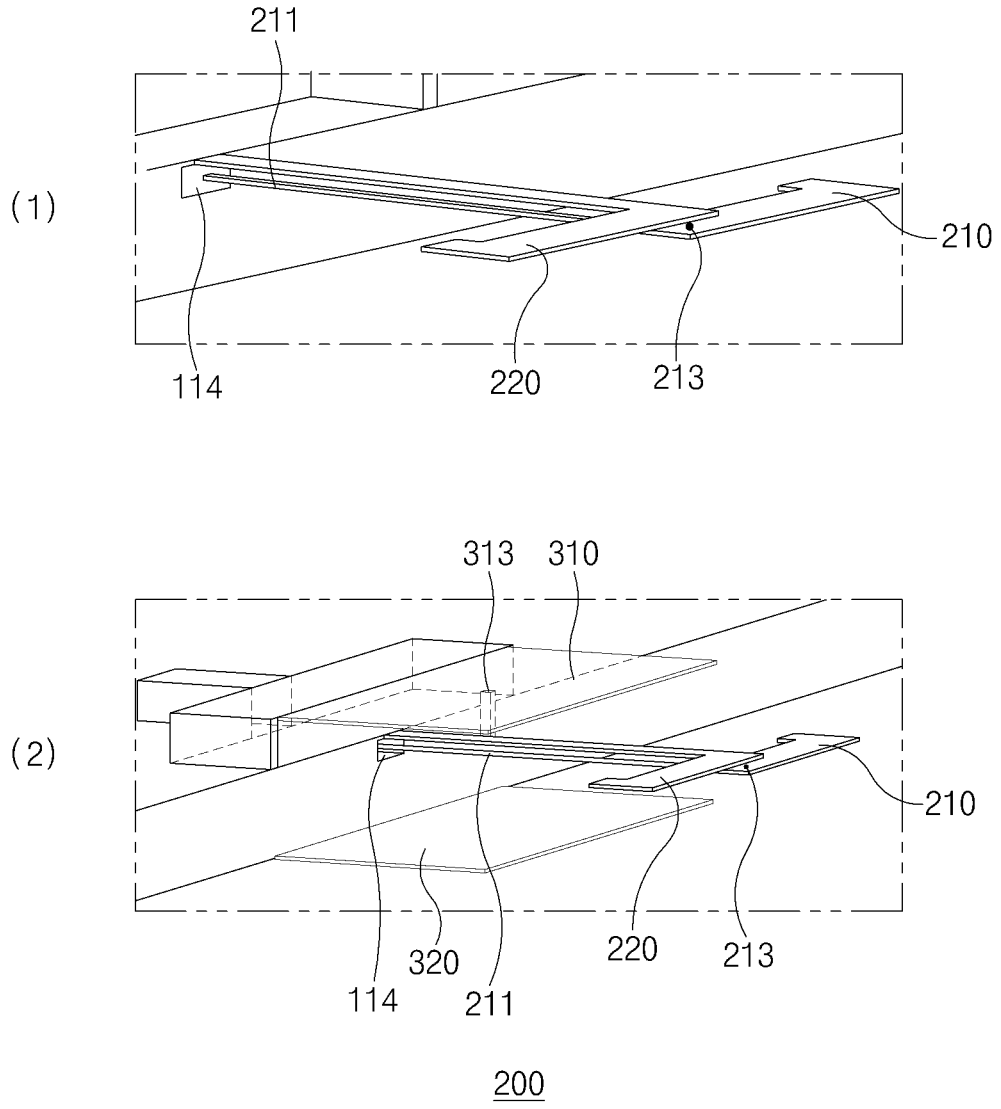
Figure 2C:
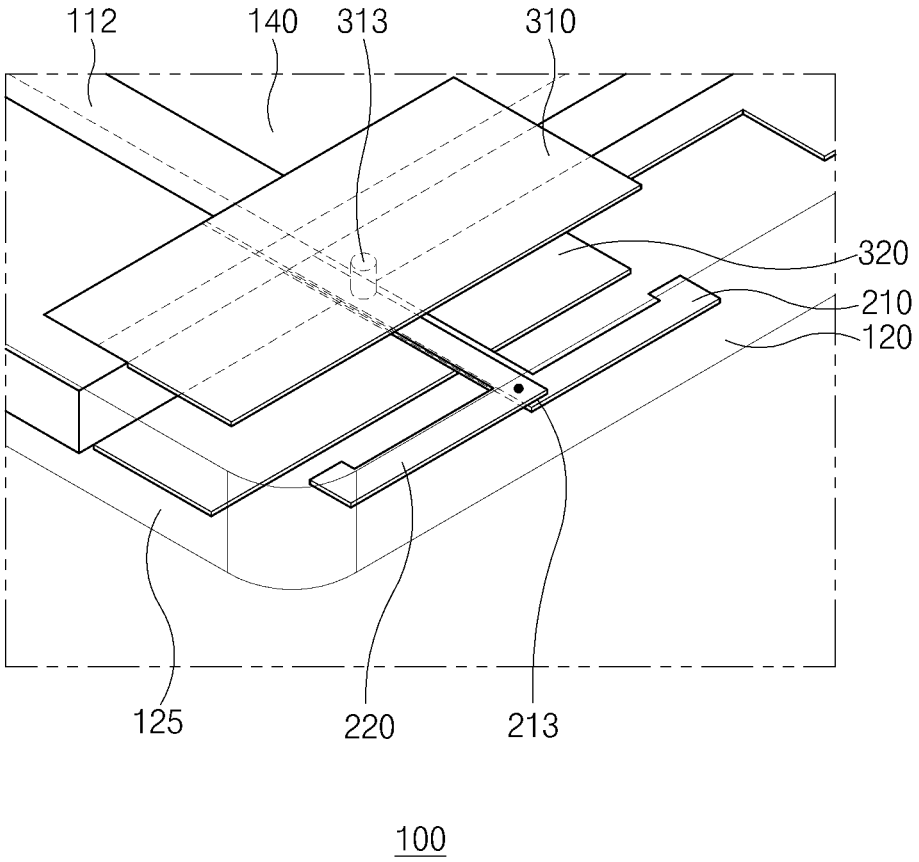

FIGS. 2A, 2B and 2C are perspective views illustrating an electronic device including a first antenna and a second antenna according to an embodiment.

An example of the electronic device 100 will be described with reference to FIGS. 2A, 2B and 2C. A patch antenna including the first antenna element 310 and the second antenna element 320 is illustrated as an example of the first antenna 300. A dipole antenna including a pair of antenna elements is illustrated as an example of the second antenna 200. With regard to FIGS. 2A, 2B and 2C, unnecessary description will be omitted.

An example of the first antenna 300 (e.g., the first antenna 300 of FIG. 1A) is illustrated in FIG. 2A. The first antenna 300 may be referred to as a "patch antenna" including the first antenna element 310 and the second antenna element 320. For example, the first antenna element 310 and the second antenna element 320 may be referred to as a "conductive plate".

In an embodiment, at least one side of the first antenna element 310 and at least one side of the second antenna element 320 may be fixed by the printed circuit board 110. The first antenna element 310 may be spaced from the second antenna element 320 and may be positioned parallel to the second antenna element 320. For example, the printed circuit board 110 may be referred to as a "low-loss printed circuit board" appropriate for a high-frequency signal.

In an embodiment, the first antenna element 310 may be fed through the first feed part 313. The second antenna element 320 may be electrically connected with a ground region. For example, the ground region may be included in the printed circuit board 110. The first antenna element 310 and the second antenna element 320 may function as a radiator of the patch antenna.

In an embodiment, the electronic device 100 may include the first feed line 315 electrically connecting the first feed part 313 included in the first antenna element 310 and the wireless communication circuit 105. For example, the first feed line 315 may be included in the printed circuit board 110. In various embodiments, the first feed line 315 may be included in a communication device (e.g., the communication device 600 of FIG. 8B or the communication device 921, 922, 923, or 924 of FIG. 9) including the first antenna 300.

For example, the wireless communication circuit 105 may be positioned at a portion of the printed circuit board 110. The first feed line 315 may be connected to the first feed part 313 through a transmission line 112 of the printed circuit board 110. The wireless communication circuit 105 may supply a power to the first feed part 313 through the first feed line 315. The wireless communication circuit 105 may transmit/receive a vertically polarized wave using the first antenna element 310 and the second antenna element 320.

In various embodiments, the printed circuit board 110 may include the cavity 113 for impedance matching for a patch antenna. For example, the cavity 113 may be formed by the printed circuit board 110, and may be referred to as an "empty space" which has a transverse length "w", a longitudinal length "h", and a height length "t" for impedance mismatching. This will be described in greater detail below with reference to FIG. 4.

An example of the second antenna 200 (e.g., the second antenna 200 of FIG. 1A) is illustrated in FIG. 2B. The second antenna 200 may be referred to as a "dipole antenna", for example, including two pairs of antenna elements. However, a structure of the dipole antenna is not limited thereto, and the dipole antenna may be formed in various structures (refer to FIG. 3). For example, the antenna elements 210 and 220 may be referred to as a "conductive element".

In an embodiment, ends of the third antenna element 210 and the fourth antenna element 220 may be implemented on the printed circuit board 110. At least a portion of the third antenna element 210 and the fourth antenna element 220 may be positioned in a space between the first antenna element 310 and the second antenna element 320. For example, when viewed from above the first antenna element 310, the first antenna element 310 may overlap at least a portion of the third antenna element 210 and the fourth antenna element 220.

In an embodiment, the one end of the fourth antenna element 220 may be electrically connected with a ground region. For example, the ground region may be included in the printed circuit board 110.

In an embodiment, the third antenna element 210 may be fed through the second feed part 213. For example, the electronic device 100 may include the second feed line 211 which is electrically connected with the second feed part 213 and extends in parallel with the third antenna element 210 and the fourth antenna element 220. For example, the second feed line 211 may be connected from the wireless communication circuit 105 to the second feed part 213 through a transmission line 114 of the printed circuit board 110. For example, the second feed line 211 may be included in the printed circuit board 110. In various embodiments, the second feed line 211 may be included in a communication device (e.g., the communication device 600 of FIG. 8B or the communication device 921, 922, 923, or 924 of FIG. 9) including the second antenna 200.

In various embodiments, the second feed part 213 may be referred to as "any one point" included in the third antenna element 210 or the fourth antenna element 220. Referring to FIG. 2B, one point 213 of the third antenna element 210 is illustrated as the second feed part 213. The third antenna element 210 and the fourth antenna element 220 may function as a radiator of a dipole antenna.

In various embodiments, the third antenna element 210 and the fourth antenna element 220 may be positioned to have the same height in parallel, or may be out of line to have different heights (e.g., to have a step). Referring to FIGS. 2A, 2B and 2C, for example, the third antenna element 210 and the fourth antenna element 220 are positioned to have a step.

Referring to FIG. 2C, the first antenna 300 and the second antenna 200 according to an embodiment may be mounted within an electronic device (e.g., the electronic device 100 of FIG. 1B). The first antenna element 310 and the second antenna element 320 may be positioned parallel to the front plate 120 and the back plate 140 of the electronic device 100. The first antenna 300 and the second antenna 200 may be positioned adjacent to a housing of an electronic device.

In an embodiment, the first antenna 300 and the second antenna 200 may be mounted within the electronic device 100 sharing the same space. In various embodiments, an array (a vertically polarized antenna array) of the first antenna 300 and an array (a horizontally polarized antenna array) of the second antenna 200 may be mounted within the electronic device 100 sharing the same space. An antenna for vertical polarization and an antenna for horizontal polarization may be mounted within the electronic device 100 while occupying a smaller space.

According to various embodiments, when viewed from above the first antenna element 310, the first antenna element 310 may overlap at least a portion of the antenna elements 210 and 220 of the second antenna 200. Referring to FIG. 2C, a portion of the antenna elements 210 and 220 of the second antenna 200 overlaps the first antenna element 310 and the second antenna element 320. For example, as the overlapping portion increases, a space occupied by the first antenna 300 and the second antenna 200 may decrease. For example, as the overlapping portion becomes smaller and of the conductive elements of the second antenna 200 protrude much more, a width of horizontal polarization radiated by the second antenna 200 may become wider.

Figure 3:
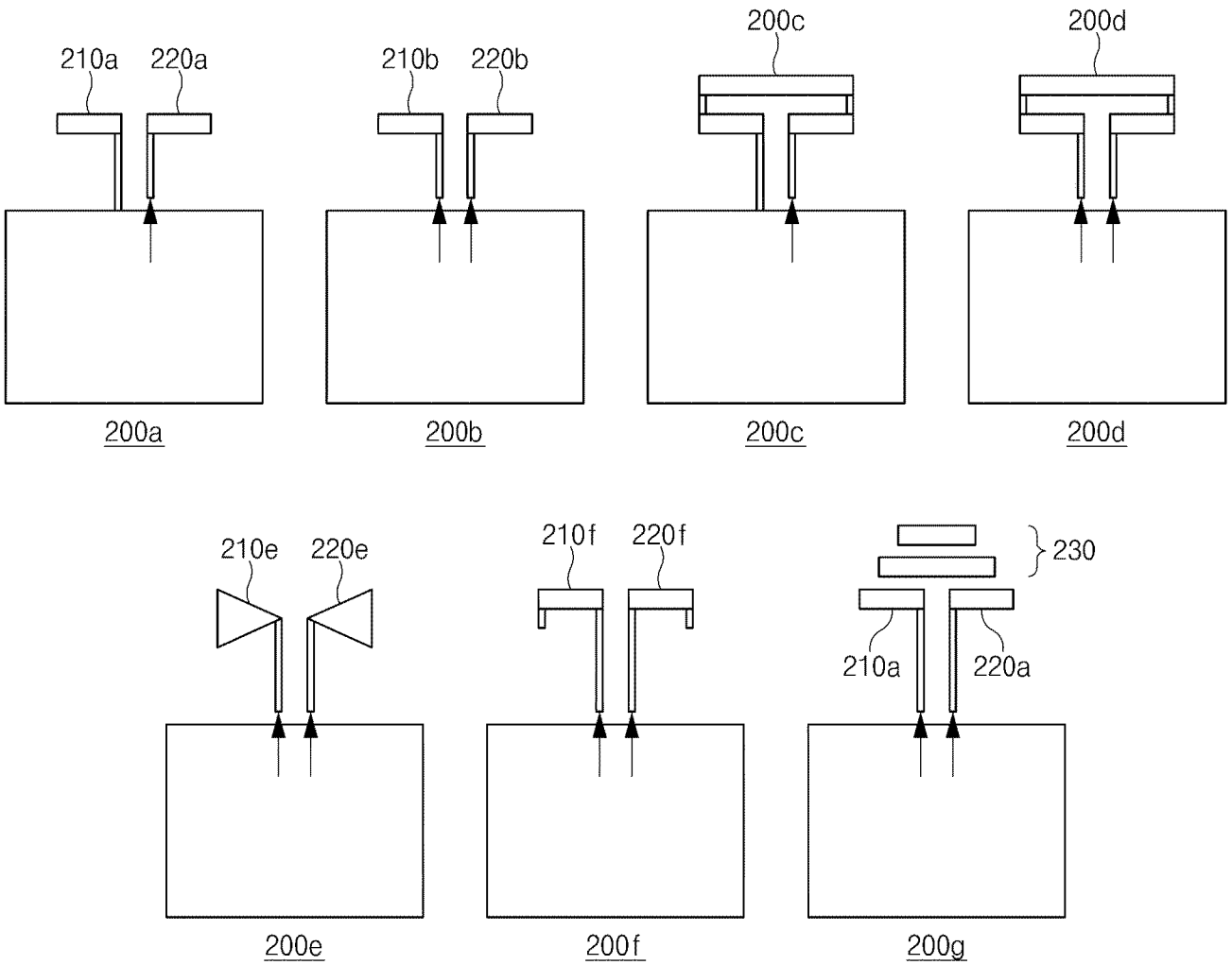
FIG. 3 is a diagram illustrating a structure of a dipole antenna according to various embodiments.

FIG. 3 is a diagram illustrating a structure of a dipole antenna according to various embodiments.

According to various embodiments, a dipole antenna for horizontal polarization may be formed in various structures. A radiator of the dipole antenna may include two pairs of conductive elements or may include a pair of conductive elements. For example, a dipole antenna including two pairs of conductive elements may have a basic dipole structure 200*a* and 200*b*, a bow-tie dipole structure 200*e*, and a bended (e.g., bent) dipole structure 200*f*. The basic dipole structure 200*a* for example, may include two pairs of conductive elements 210*a* and 220*a*. The basic dipole structure 200*b* for example, may include two pairs of conductive elements 210*b* and 220*b*. The bow-tie dipole structure 200*e* for example, may include two pairs of conductive elements 210*e* and 220*e*. The bended dipole structure 200*f* for example, may include two pairs of conductive elements 210*f* and 220*f*. An antenna of a basic dipole structure including two pairs of conductive elements is illustrated in FIGS. 2A, 2B and 2C. For example, a dipole antenna including one conductive element may have folded dipole structures 200*c* and 200*d*.

According to various embodiments, the dipole antenna may have a single feed structure or a dual feed (or balanced feed) structure. For example, structure 200*a* and structure 200*c* may correspond to the single feed structure. Referring to structure 200*a*, a feed part may be positioned at a conductive element 220*a*, and a conductive element 210*a* may be electrically connected to a ground region. For example, structure 200*b*, structure 200*d*, structure 200*e*, and structure 200*g* may correspond to the dual feed structure. However, the dipole antennas illustrated in FIG. 3 may be implemented to have the single feed structure or the dual feed structure.

A dipole antenna of a single feed structure is illustrated in FIGS. 2A, 2B and 2C. For example, two feed points of a dipole antenna having the dual feed structure may be fed to have a phase difference of 180 degrees. In the case where the dipole antenna of the dual feed structure includes two pairs of conductive elements, each conductive element may include a feed point.

According to various embodiments, the dipole antenna may include a director 230. The director 230 may make directivity of the dipole antenna better. Referring to structure 200*g*, for example, the director 230 may be positioned in a direction of horizontal polarization from the dipole antenna. The director 230 may make directivity of horizontal polarization better.

Figure 4A:
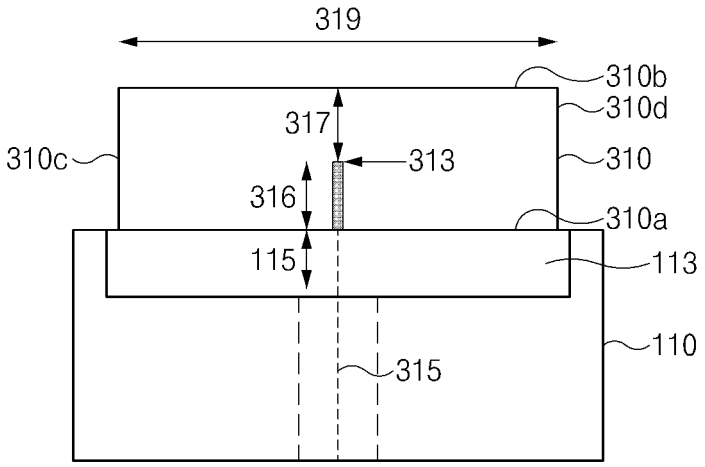
FIGS. 4A, 4B and 4C are diagrams illustrating structures of an antenna element included in a first antenna device according to an embodiment.
Figure 4B:
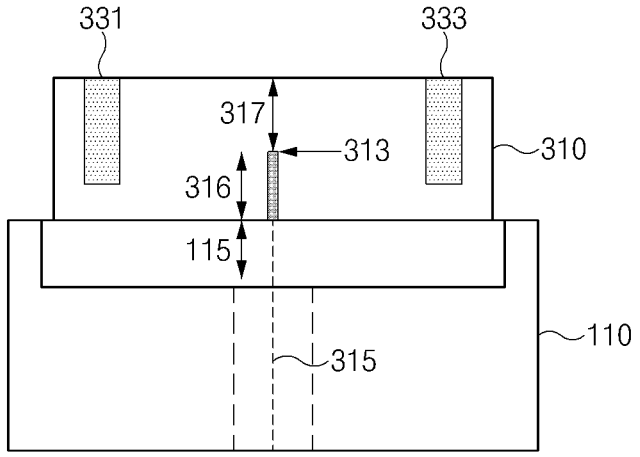
Figure 4C:
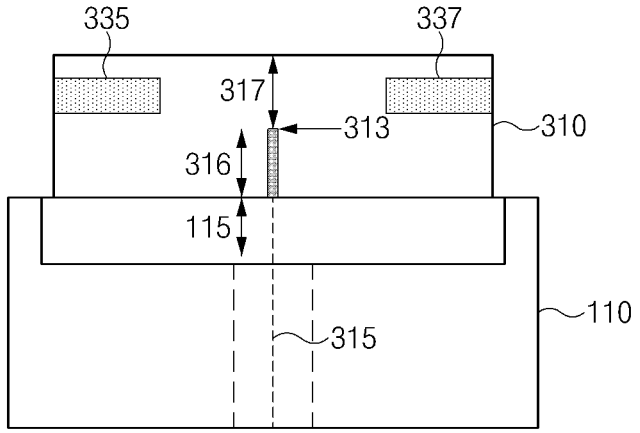

FIGS. 4A, 4B and 4C are diagrams illustrating structures of an antenna element included in a first antenna device according to an embodiment.

In an embodiment, referring to FIG. 4A, the first antenna element 310 may include a first side 310*a* coupled with the printed circuit board 110, a second side 310*b* facing away from the first side 310*a*, and a third side 310*c* and a fourth side 310*d* connecting opposite ends of the first side 310*a* and opposite ends of the second side 310*b*.

In various embodiments, a distance 316 from the first side 310*a* of the first antenna element 310 to the feed part 313 may be associated with impedance matching. For example, impedance matching may be made by the distance 315 and a gap between the first conductive element 310 and the second conductive element 320.

In various embodiments, the distance 316 from the first side 310*a* of the first antenna element 310 to the feed part 313 and a longitudinal length (h) 115 of the cavity 113 may be associated with impedance matching. For example, a distance corresponding to a sum of the longitudinal length (h) 115 and the distance 316 being a distance from the cavity 113 to the feed part 313 may be designed to have a distance for impedance mismatching. When the electronic device 100 is implemented with different parts, impedance matching may be made by adjusting the distance 316 and the longitudinal length (h) 115. For example, even though a gap between the first conductive element 310 and the second conductive element 320 becomes small depending on a height (or a thicknesses) of the printed circuit board 110, impedance matching may be made through the cavity 113.

In various embodiments, a structure of the cavity 113 may be associated with impedance matching. For example, the cavity 113 may have the transverse length "w", the longitudinal length "h", and the height length "t" (refer to FIG. 1A). A gap between an upper surface and a lower surface of the cavity 113 may be referred to as a "height" (t). When a high-frequency signal is transmitted/received through the first antenna 300, an inductance and a capacitance which are based on the gap between the upper surface and the lower surface of the cavity 113 may vary with a frequency of the transmitted/received signal. Impedance matching may be performed using the gap of the cavity 113.

In various embodiments, a wireless communication circuit (e.g., the wireless communication circuit 105 of FIG. 1A) may transmit/receive a vertically polarized wave having a frequency corresponding to the structure of the first antenna element 310.

For example, the wireless communication circuit may be configured to transmit/receive a vertically polarized wave in a frequency band corresponding to a distance 317 from the second side 310*b* to the feed part 313. The distance 317 may be differently designed according to a target frequency of a signal to be transmitted/received through the first antenna 300. For example, a location of the feed part 313 may be changed according to a target frequency.

In various embodiments, the wireless communication circuit may transmit/receive a vertically polarized wave having a bandwidth corresponding to the structure of the first antenna element 310.

For example, the wireless communication circuit may be configured to transmit/receive a vertically polarized wave in a bandwidth corresponding to a distance 319 between the third side 310*c* and the fourth side 310*d*. The distance 319 may be differently designed according to a target bandwidth of a signal to be transmitted/received through the first antenna 300. A transverse width 319 of the first antenna element may become greater for bandwidth expansion.

For example, a bandwidth may be expanded by adding at least one slit to the first antenna element 310. The first antenna element 310 may include at least one slit which is extended from the second side 310*b*, the third side 310*c*, or the fourth side 310*d*. The wireless communication circuit may be configured to transmit/receive a vertically polarized wave having a bandwidth which is formed by the at least one slit. At least one slit may be added to the first antenna element 310 for bandwidth expansion.

Referring to FIG. 4B, two slits 331 and 333 extending from the second side 310*b* are illustrated. Referring to FIG. 4C, the slit 335 extending from the third side 310*c* and the slit 337 extending from the fourth side 310*d* are illustrated. In this manner, for example, a bandwidth of a patch antenna may be expanded.

Figure 5:
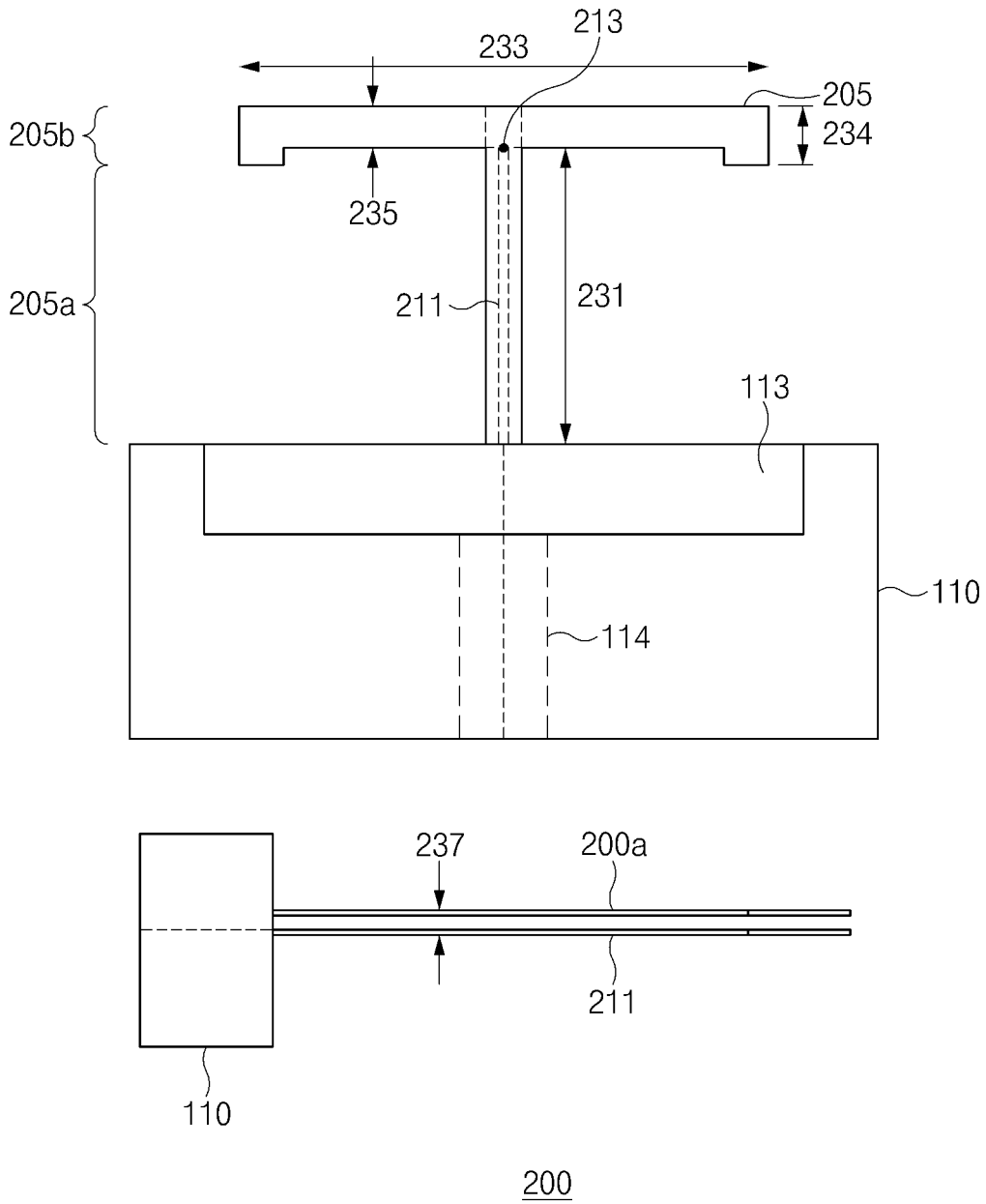
FIG. 5 is a diagram illustrating a structure of an antenna element included in a second antenna device according to an embodiment.

FIG. 5 is a diagram illustrating a structure of an antenna element included in a second antenna device according to an embodiment.

In an embodiment, the second antenna 200 may include an antenna element 205. For example, the antenna element 205 may be referred to as a "conductive element". For example, the antenna element 205 may comprise a conductive element of any one of the structures of the dipole antenna described with reference to FIG. 3. The antenna element 205 may include a first portion 205*a* extending from the printed circuit board 110 and a second portion 205*b* perpendicular to the first portion 205*a*. The antenna element 205 may function as a radiator of the dipole antenna. In particular, the second portion 205*b* may function as a main radiator of the dipole antenna.

In various embodiments, the feed part 213 may be included in the second portion 205*b*. For example, the electronic device 100 may include the feed line 211 which is electrically connected with the feed part 213 included in the second portion 205*b* and extends in parallel with the first portion 205*a* of the antenna element 205. One end of the first portion 205*a* may be electrically connected with a ground region of the printed circuit board 110.

In various embodiments, a distance 231 from the one end of the first portion 205*a*, which is coupled with the printed circuit board 110, to the feed part 213 may be associated with impedance matching. For example, the distance 231 may be designed to have a distance for impedance mismatching. When the second antenna 200 is implemented with different parts, impedance matching may be made by adjusting the distance 231.

In various embodiments, the feed line 211 and the first portion 205*a* may be positioned parallel to each other with a gap. The gap may be associated with impedance matching. For example, the feed line 211 and the first portion 205*a* may be positioned parallel to each other with a gap 237 of a magnitude for impedance mismatching. When the second antenna 200 is implemented with different parts, impedance matching may be made by adjusting the magnitude of the gap 237. According to various embodiments, the distance 231 and the gap 237 may be designed to have a length and a magnitude for impedance mismatching.

In various embodiments, a wireless communication circuit (e.g., the wireless communication circuit 105 of FIG. 1A) may transmit/receive a horizontally polarized wave having a frequency corresponding to the structure of the antenna element 205. For example, the wireless communication circuit 105 may transmit/receive a horizontally polarized wave in a frequency band corresponding to a length 233 of a horizontal edge of the second portion 205*b* and a length 234 of a vertical edge of the second portion 205*b*. The length 233 of the horizontal edge and the length 234 of the vertical edge may be differently designed according to a target frequency of a signal to be transmitted/received through the second antenna 200.

In various embodiments, the wireless communication circuit may transmit/receive a vertically polarized wave having a bandwidth corresponding to the structure of the antenna element 205. For example, the wireless communication circuit may be configured to transmit/receive a vertically polarized wave having a bandwidth corresponding to the distance 235 of the second portion 205*b*. The distance 235 of the second portion 205*b* may be differently designed according to a target bandwidth of a signal to be transmitted/received through the electronic device 100. The thickness 235 may become thicker for bandwidth expansion.

Figure 6:
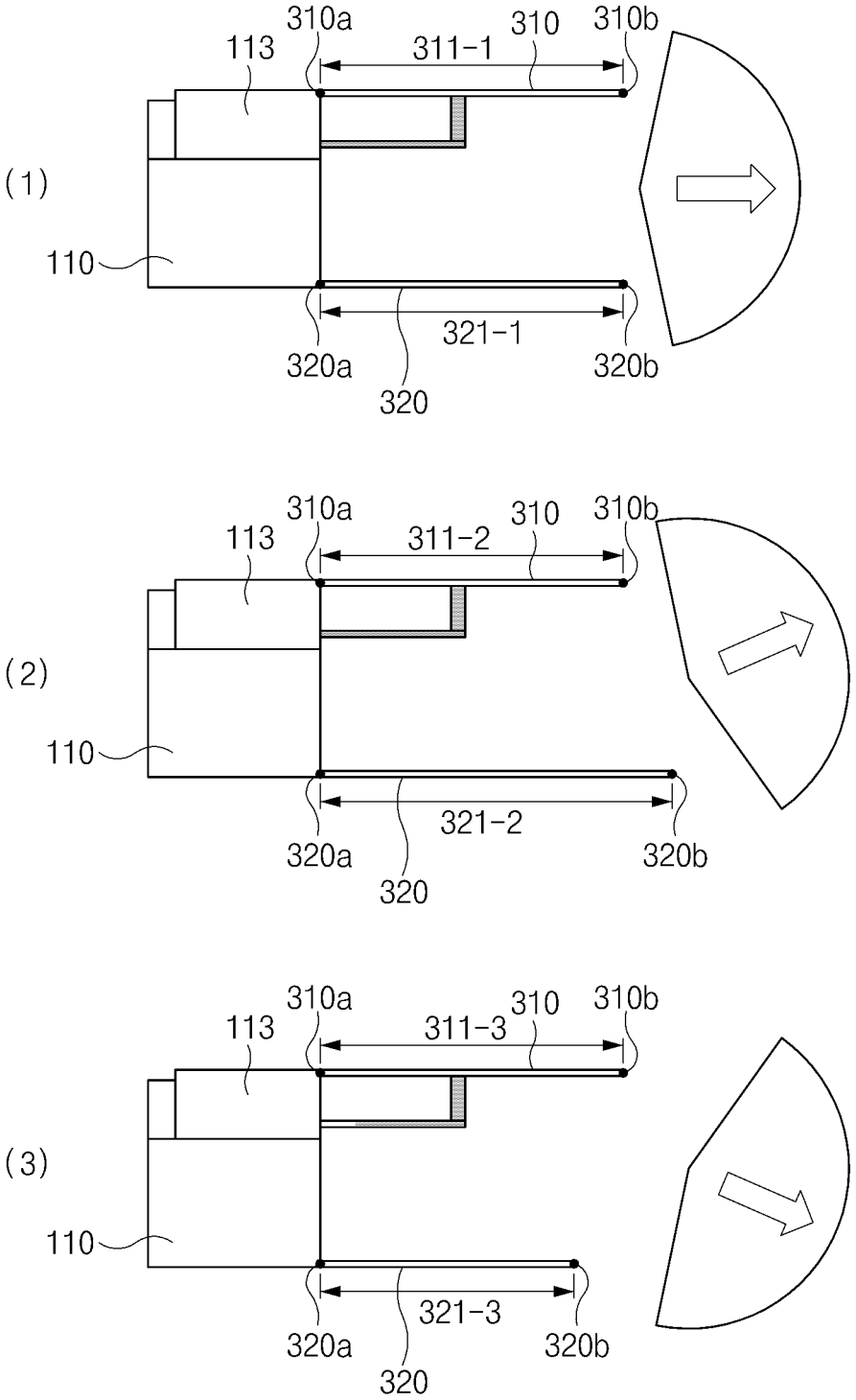
FIG. 6 is a diagram illustrating a structure for adjusting a direction of a beam radiated by a first antenna and a second antenna according to various embodiments.

FIG. 6 is a diagram illustrating a structure for adjusting a direction of a beam radiated by a first antenna and a second antenna according to various embodiments.

In an embodiment, the first antenna element 310 of a first antenna element (e.g., the first antenna 300 of FIG. 1A) may have a first distance 311-1, 311-2, or 311-3 from one end 310*a* (e.g., the first side 310*a* of FIG. 4A) of the first antenna element 310, which is coupled with the printed circuit board 110, to an opposite end 310*b* (e.g., the second side 310*b* of FIG. 6) of the first antenna element 310. The first distance 311-1, 311-2, or 311-3 may be referred to as a "vertical distance" from the one end 310*a* of the first antenna element 310 to the opposite end 310*b* of the first antenna element 310. The second antenna element 320 of the first antenna may have a second distance 321-1, 321-2, or 321-3 from one end 320*a* of the second antenna element 320, which is coupled with the printed circuit board 110, to an opposite end 320*b* of the second antenna element 320. The second distance 321-1, 321-2, or 321-3 may be referred to as a "vertical distance" from the one end 320*a* of the second antenna element 320 to the opposite end 320*b* of the second antenna element 320.

In various embodiments, a wireless communication circuit (e.g., the wireless communication circuit 105 of FIG. 1A) may be configured to transmit/receive a dual polarized wave having directivity using the first distance 311-1, 311-2, or 311-3 and the second distance 321-1, 321-2, or 321-3.

Referring to (1) of FIG. 6, the first distance 311-1 may be identical to the second distance 321-1. A dual polarized wave by the first antenna and a second antenna (e.g., the second antenna 200) may have directivity in a horizontal direction.

Referring to (2) of FIG. 6, the first distance 311-2 may be shorter than the second distance 321-2. A dual polarized wave by the first antenna and the second antenna (e.g., the second antenna 200) may have directivity in an upward direction.

Referring to (3) of FIG. 6, the first distance 311-3 may be longer than the second distance 321-3. A dual polarized wave by the first antenna and the second antenna may have directivity in a downward direction.

Figure 7:
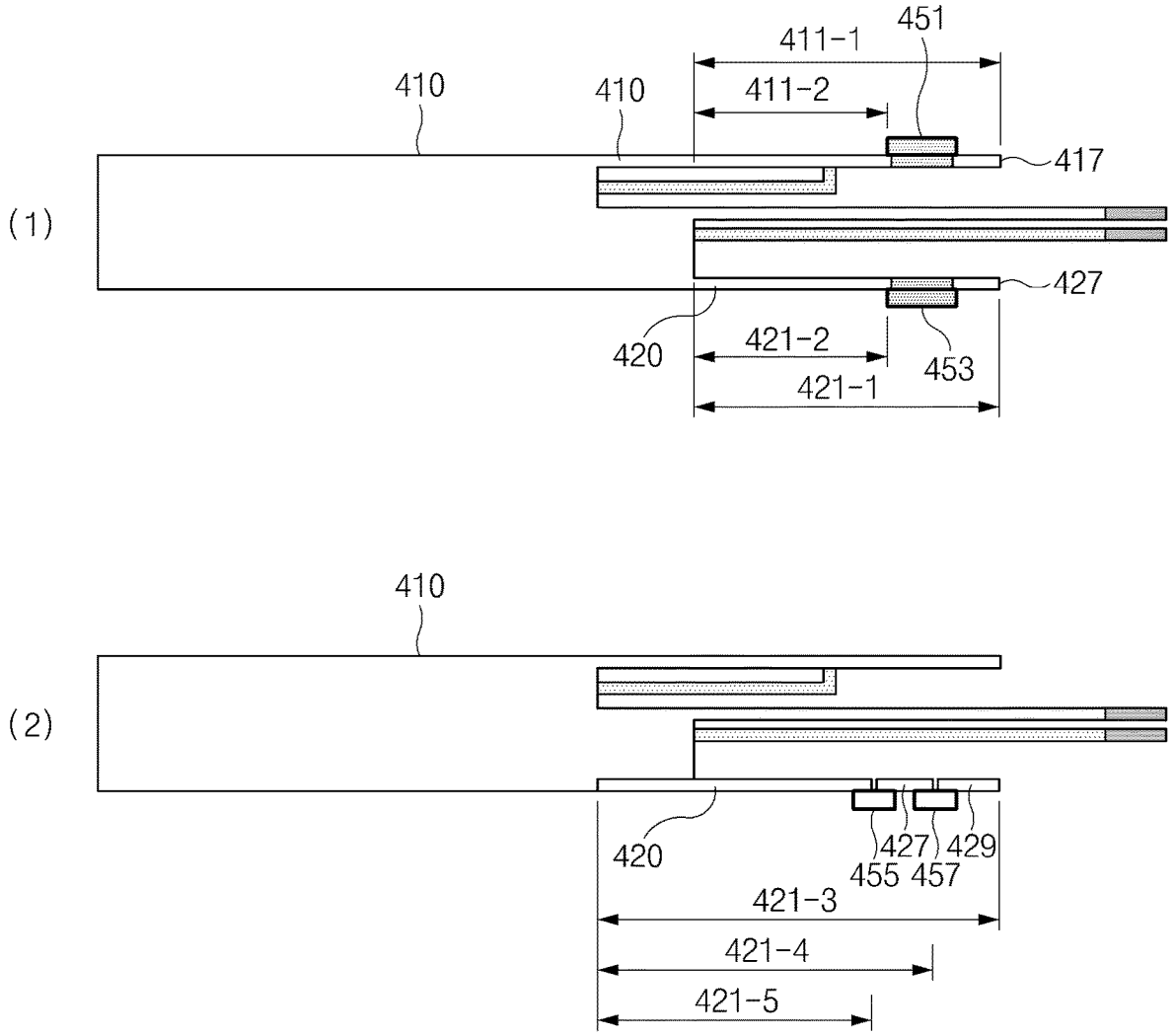
FIG. 7 is a diagram illustrating a structure and a switching operation of an antenna including a switching element according to various embodiments.

FIG. 7 is a diagram illustrating a structure and a switching operation of an antenna including a switching element according to various embodiments.

In various embodiments, an electronic device 400 (e.g., the electronic device 100 of FIG. 1A) may include a switching element 451, 453, 455, or 457 for adjusting an electrical length of a first antenna element 410 (e.g., the first antenna element 310 of FIG. 1A) and/or a second antenna element 420 (e.g., the second antenna element 320 of FIG. 1A).

According to an embodiment, the switching element 451, 453, 455, or 457 may be mounted on the first antenna element 410 and/or the second antenna element 420. For example, the switching element 451, 453, 455, or 457 may be referred to as a "microelectromechanical system (MEMS) switch for high frequency", a "single pole double throw (SPDT)" switch, or the like. A processor (e.g., a processor 1120 of FIG. 11) of the electronic device 400 may receive an on/off signal of the switching element 451, 453, 455, or 457 and may change an electrical length of the first antenna element 410 and/or the second antenna element 420.

According to an embodiment, the first antenna element 410 and/or the second antenna element 420 may include a plurality of portions which are electrically separated from each other. For example, at least one or more conductive patterns 417, 427, and 429 electrically separated from each other may be coupled with the first antenna element 410 and/or the second antenna element 420.

In an embodiment, the switching elements 451, 453, 455, and 457 may be configured to electrically connect the plurality of electrically separated portions selectively.

Referring to (1) of FIG. 7, the electrically separated conductive patterns 417, 427 may be coupled with the first antenna element 410 and the second antenna element 420, respectively.

In an embodiment, the switching element 451 may be interposed between the first antenna element 410 and the conductive pattern 417. The switching element 451 may electrically connect or disconnect the first antenna element 410 to or from the conductive pattern 417 through a switching operation. As such, the electrical length (e.g., the first distance 311-1, 311-2, and 311-3 of FIG. 6) of the first antenna element 410 may change. For example, the electrical length of the first antenna element 410 may have a first electrical length 411-1 or a second electrical length 411-2.

In an embodiment, the switching element 453 may be interposed between the first antenna element 420 and the conductive pattern 427. The switching element 457 may electrically connect or disconnect the first antenna element 420 to or from the conductive pattern 427 through a switching operation. As such, the electrical length (e.g., the second distance 321-1, 321-2, and 321-3 of FIG. 6) of the first antenna element 420 may change. For example, the electrical length of the second antenna element 420 may have a third electrical length 421-1 or a fourth electrical length 421-2.

The electronic device 100 may radiate a vertically polarized wave and a horizontally polarized wave having directivity depending on a relative length of the first antenna element 410 and the second antenna element 420, which is adjusted through switching operations of the switching elements 451 and 453. A direction of the directivity is described with reference to FIG. 6.

In an embodiment, the first antenna may adjust a resonant frequency of the first antenna using the switching elements 451 and 453. For example, as the switching elements 451 and 453 change from an On state to an Off state, the first electrical length 411-1 of the first antenna element 410 may be changed to the second electrical length 411-2, and the third electrical length 421-1 of the second antenna element 420 may be changed to the fourth electrical length 421-2. As such, the resonant frequency of the first antenna may become higher.

Referring to (2) of FIG. 7, the plurality of electrically separated conductive patterns 427 and 429 may be coupled with the second antenna element 420.

In an embodiment, when viewed from above the second antenna element 420, at least a portion of the switching element 455 may be interposed between the second antenna element 420 and the conductive pattern 427. In an embodiment, when viewed from above the second antenna element 420, at least a portion of the switching element 457 may be interposed between the conductive pattern 427 and the conductive pattern 429. The switching elements 455 and 457 may electrically connect or disconnect the second antenna element 420 to or from the conductive patterns 427 and 429 through a switching operation. As such, the electrical length (e.g., a second distance of FIG. 6) of the second antenna element 420 may change. For example, an electrical length 421-3 of the second antenna element 420 may have a length 421-4 or a length 421-5. For example, as the electrical length of the second antenna element 420 becomes longer, upward directivity of a vertically polarized wave and a horizontally polarized wave radiated by an electronic device 200 may become stronger.

Figure 8A:
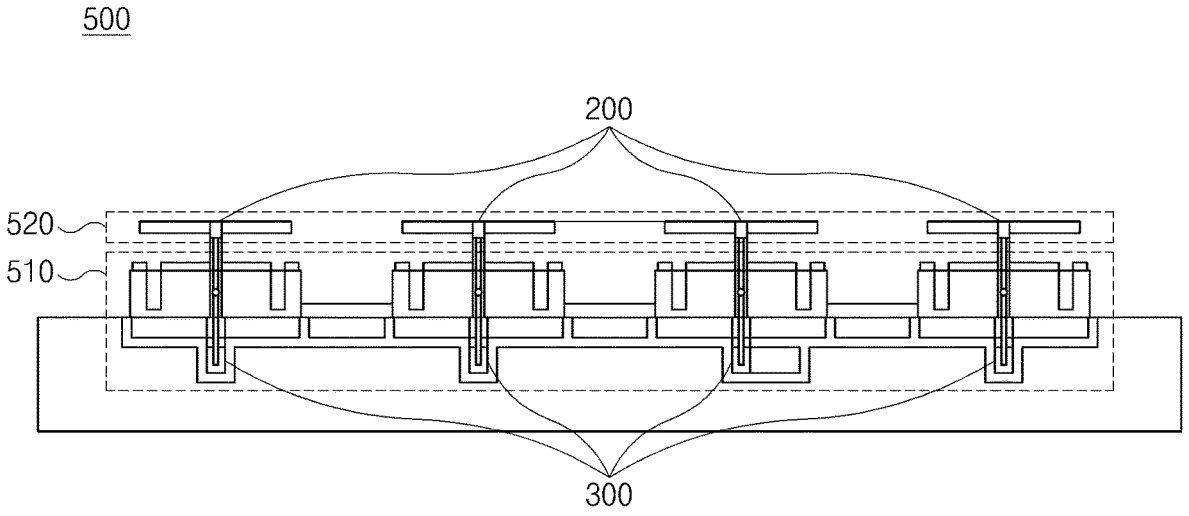
FIG. 8A is a diagram illustrating a structure of an array module including an antenna array including a plurality of horizontally polarized antennas and an antenna array including a plurality of vertically polarized antennas in various embodiments.
Figure 8B:
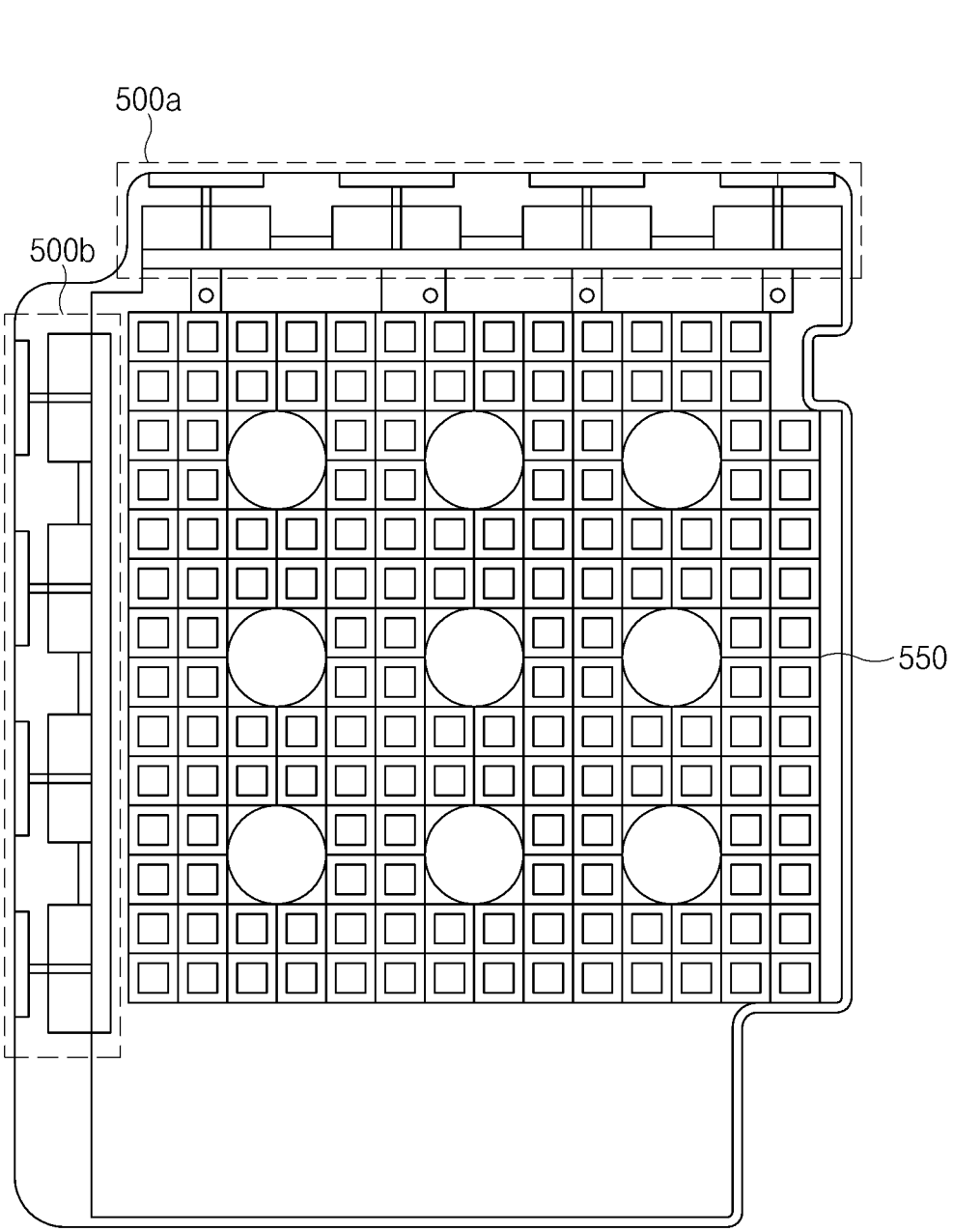
FIG. 8B is a diagram illustrating a communication device according to various embodiments.
Figure 8C:
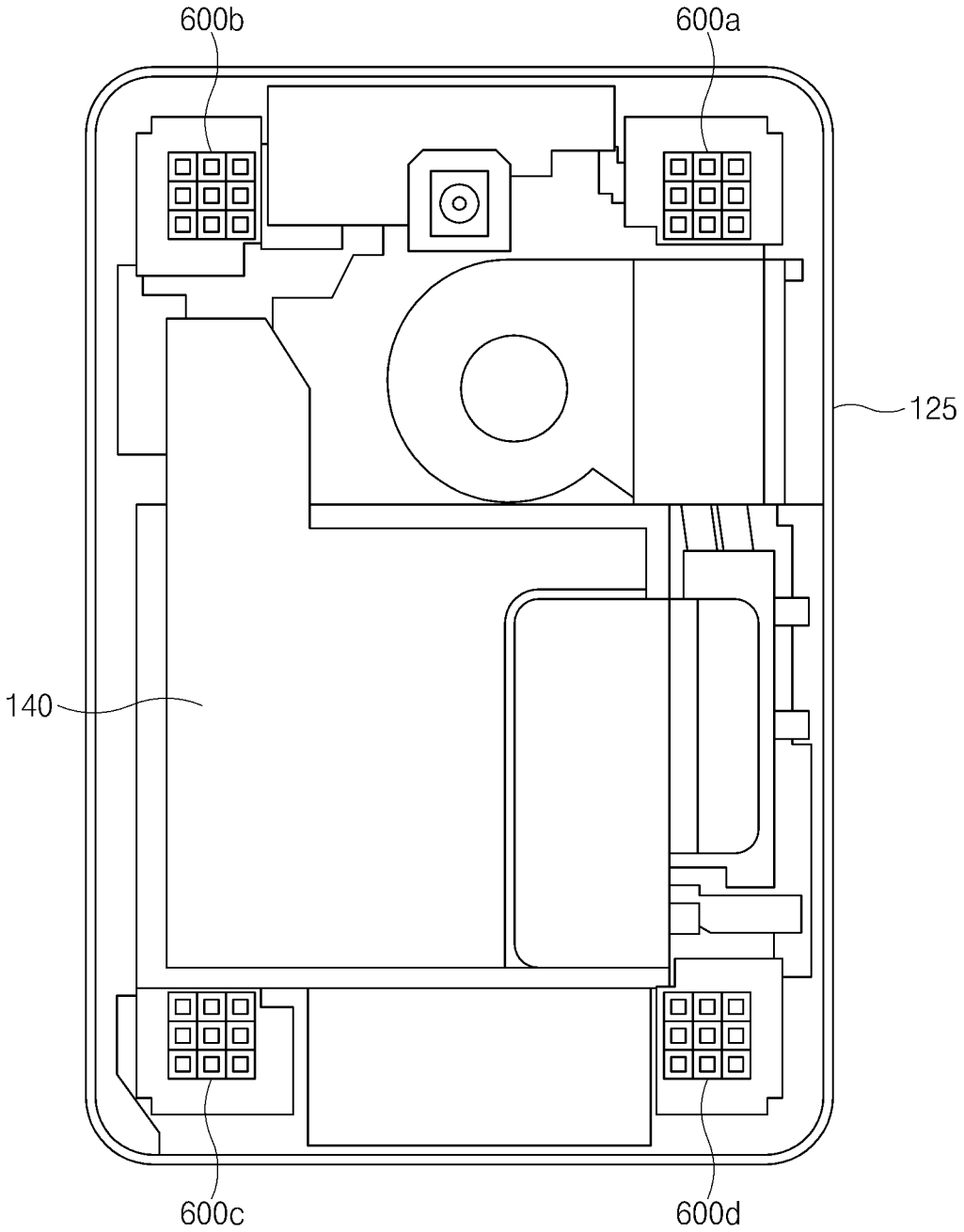
FIG. 8C is a diagram illustrating an internal structure of an electronic device including a communication device in various embodiments.

FIG. 8A is a diagram illustrating a structure of an array module 500 including an antenna array 520 including a plurality of horizontally polarized antennas and an antenna array 510 including a plurality of vertically polarized antennas in various embodiments. FIG. 8B is a view illustrating one exemplification of a communication device according to various embodiments. FIG. 8C is a view illustrating an internal structure of an electronic device including a communication device in various embodiments.

Referring to FIG. 8A, an array module 500 may include a first antenna array 510 and a second antenna array 520. For example, the first antenna array 510 may include a plurality of first antennas 300. The first antenna array 510 may be referred to as a "vertically polarized antenna array". For example, the second antenna array 520 may include a plurality of second antennas 200. The second antenna array 520 may be referred to as a "horizontally polarized antenna array". Directivity of a vertically polarized wave and a horizontally polarized wave of the electronic device 100 may be improved as the first antenna 300 and the second array 200 are implemented with an antenna array. The plurality of first antennas 300 and the plurality of second antennas 200 may be positioned to be spaced from each other as much as a given distance, and may constitute antenna arrays.

In an embodiment, a portion of the first antenna array 510 and a portion of the second antenna array 520 may be positioned to overlap with each other. As described above, the first antenna 300 included in the first antenna array 510 and the second antenna 200 included in the second antenna array 520 may be mounted to share the same space. As such, the first antenna array 510 and the second antenna array 520 may share the same space.

Referring to FIG. 8B, the array module 500 and a wireless communication circuit (e.g., the wireless communication circuit 105 of FIG. 1A) may comprise a communication device 600. For example, the communication device 600 may include an array module 500*a* aligned in a first direction and an array module 500*b* aligned in a second direction.

Figure 9:
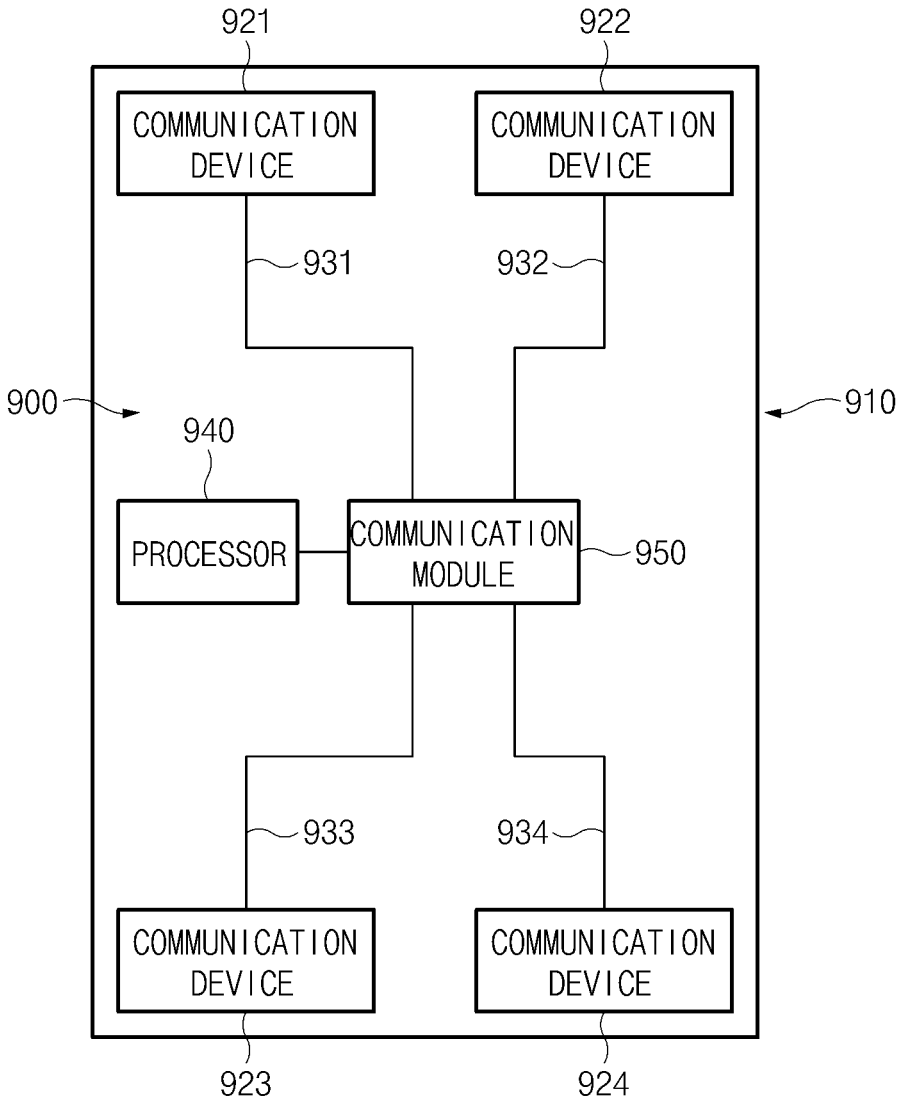
FIG. 9 is a block diagram illustrating an example of an electronic device supporting 5G communication.

In various embodiments, the communication device 600 may be mounted in an electronic device (e.g., the electronic device 100 of FIG. 1B or an electronic device 900 of FIG. 9). For example, the communication device 600 may radiate an RF signal toward a side surface of an electronic device (e.g., the electronic device 100 of FIG. 1B) using the array module 500*a* and the array module 500*b*. For example, the array module 500*a* may be aligned along any one side of the side member 125, and the array module 500*b* may be aligned along another side perpendicular to the one side. A structure in which the communication device 600 is mounted at an electronic device will be described with reference to FIG. 9.

In various embodiments, the communication device 600 may include a patch antenna array 550 for radiating a signal in a direction perpendicular to a front plate or a back plate. The electronic device 100 may radiate a signal toward a side surface and a front/back surface through the communication device 600.

Referring to FIG. 8C, according to various embodiments, an illustrating in which the communication devices 600 of the electronic device 100 are respectively positioned on the right top 600*a*, the right bottom 600*d*, the left top 600*b*, and the left bottom 600*c*. However, the present disclosure is not limited thereto. The plurality of communication devices 600 may be mounted at any location in the electronic device 100.

FIG. 9 is a block diagram illustrating an example of an electronic device supporting 5G communication.

Referring to FIG. 9, an electronic device 900 (e.g., the electronic device 100 of FIG. 1B) may include a housing 910, a processor (e.g., including processing circuitry) 940, a communication module (e.g., including communication circuitry) 950 (e.g., a communication module 1190 of FIG. 11), a first communication device (e.g., including communication circuitry) 921, a second communication device (e.g., including communication circuitry) 922, a third communication device (e.g., including communication circuitry) 923, a fourth communication device (e.g., including communication circuitry) 924, a first conductive line 931, a second conductive line 932, a third conductive line 933, and/or a fourth conductive line 934. For example, the first communication device 921, the second communication device 922, the third communication device 923, and the fourth communication device 924 may be referred to as the "communication device" 600 of FIG. 8B.

According to an embodiment, the housing 910 may protect any other components of the electronic device 900. The housing 910 may include, for example, a front plate (e.g., the front plate 120 of FIG. 1B), a back plate (e.g., the back surface 140 of FIG. 1B) facing away from the front plate, and a side member (or a metal frame) (e.g., the side member 125 of FIG. 1B) surrounding a space between the front plate and the back plate. The side member may be attached to the back plate or may be integrally formed with the back plate.

According to an embodiment, the electronic device 900 may include at least one communication device. For example, the electronic device 900 may include the first communication device 921, the second communication device 922, the third communication device 923, and/or the fourth communication device 924.

According to an embodiment, the first communication device 921, the second communication device 922, the third communication device 923, and/or the fourth communication device 924 may be positioned within the housing 910. According to an embodiment, when viewed from above the front plate of the electronic device 900, the first communication device 921 may be positioned on the left top of the electronic device 900, the second communication device 922 may be positioned on the right top of the electronic device 900, the third communication device 923 may be positioned on the left bottom of the electronic device 900, and the fourth communication device 924 may be positioned on the right bottom of the electronic device 900.

According to an embodiment, the processor 940 may include various processing circuitry, such as, for example, and without limitation, one or more of a central processing unit, an application processor, a graphic processing unit (GPU), an image signal processor of a camera, a baseband processor (or a communication processor (CP)), or the like. According to an embodiment, the processor 940 may be implemented with a system on chip (SoC) or a system in package (SiP).

According to an embodiment, the communication module 950 may be electrically connected with at least one communication device using at least one conductive line. For example, the communication module 950 may be electrically connected with the first communication device 921, the second communication device 922, the third communication device 923, or the fourth communication device 924 using the first conductive line 931, the second conductive line 932, the third conductive line 933, or the fourth conductive line 934. The communication module 950 may include various communication circuitry, such as, for example, and without limitation, one or more of a baseband processor, a radio frequency integrated circuit (RFIC), and/or an intermediate frequency integrated circuit (IFIC), or the like. The communication module 950 may include a baseband processor which is independent of the processor 940 (e.g., an application processor (AP)). The first conductive line 931, the second conductive line 932, the third conductive line 933, or the fourth conductive line 934 may include, for example, a coaxial cable or a flexible PCB (FPCB).

According to an embodiment, the communication module 950 may include a first baseband processor (BP) (not illustrated) or a second baseband processor (not illustrated). The electronic device 900 may further include one or more interfaces for supporting inter-chip communication between the first BP (or the second BP) and the processor 940. The processor 940 and the first BP or the second BP may transmit/receive data using the inter-chip interface (e.g., an inter processor communication channel).

According to an embodiment, the first BP or the second BP may provide an interface for performing communication with any other entities. The first BP may support, for example, wireless communication with regard to a first network (not illustrated). The second BP may support, for example, wireless communication with regard to a second network (not illustrated).

According to an embodiment, the first BP or the second BP may form one module with the processor 940. For example, the first BP or the second BP may be integrally formed with the processor 940. For another example, the first BP or the second BP may be positioned within one chip or may be implemented in the form of an independent chip. According to an embodiment, the processor 940 and at least one baseband processor (e.g., the first BP) may be integrally formed within one chip (e.g., an SoC), and another baseband processor (e.g., the second BP) may be implemented in the form of an independent chip.

Figure 11:
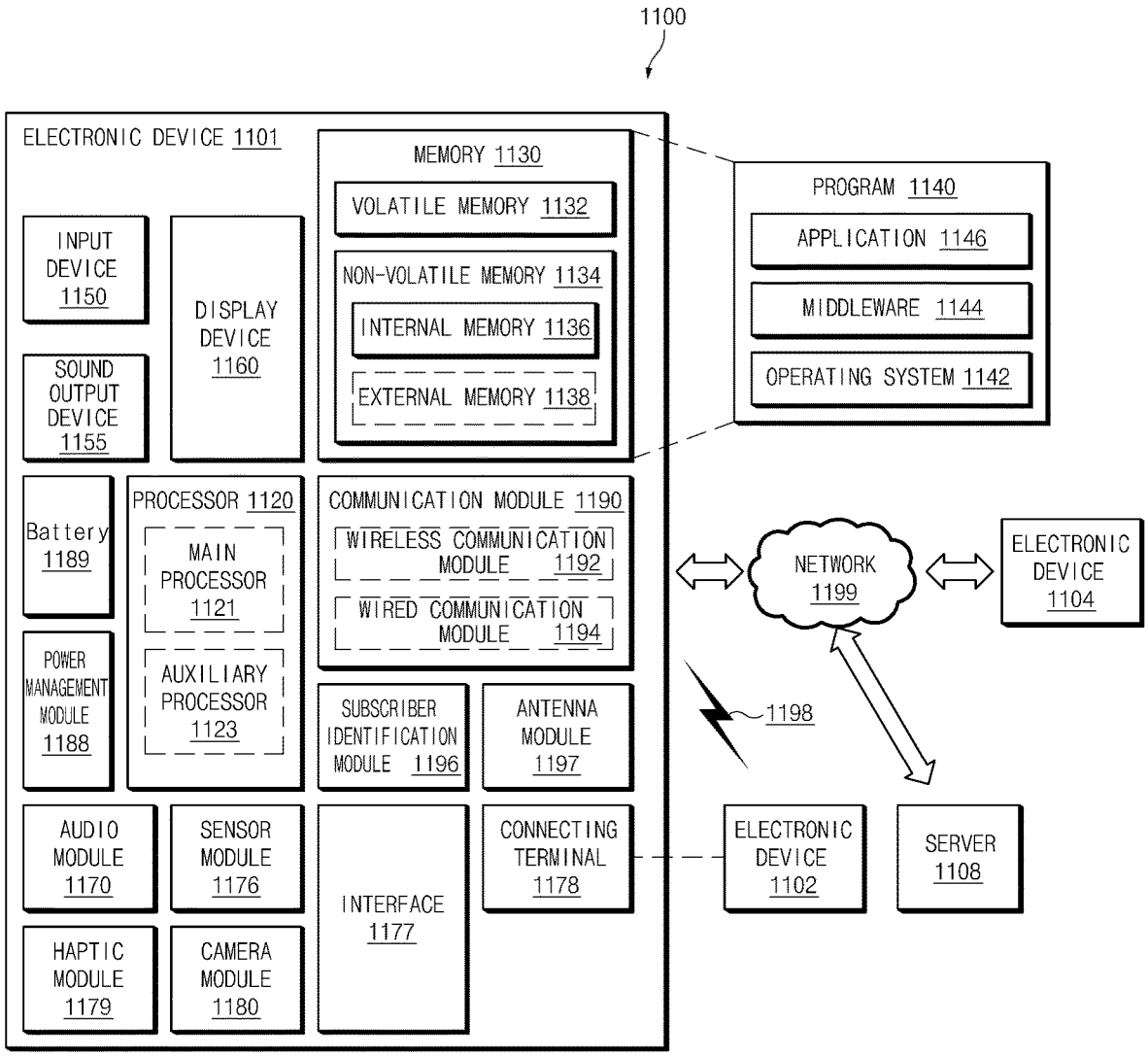
FIG. 11 is a block diagram of an electronic device in a network environment, according to various embodiments.

According to an embodiment, the first network (not illustrated) or the second network (not illustrated) may correspond to a network 199 of FIG. 11. According to an embodiment, the first network (not illustrated) and the second network (not illustrated) may include a $4^{th}$ generation (4G) network and a $5^{th}$ generation (5G) network, respectively. The 4G network may support, for example, a long term evolution (LTE) protocol defined in the 3GPP. The 5G network may support, for example, a new radio (NR) protocol defined in the 3GPP.

Figure 10:
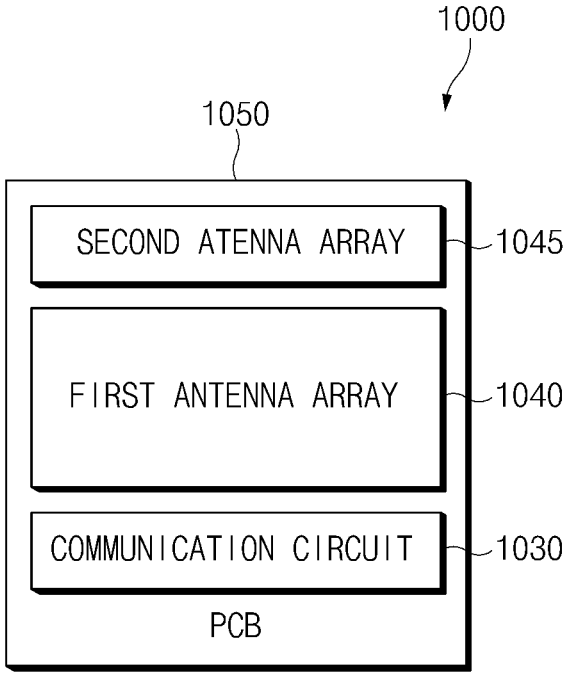
FIG. 10 is a block diagram illustrating an example of a communication device.

FIG. 10 is a block diagram illustrating an example of a communication device.

Referring to FIG. 10, a communication device 1000 may include a communication circuit 1030 (e.g., an RFIC), and a PCB 1050, at least one antenna array (e.g., a first antenna array 1040 and/or a second antenna array 1045).

According to an embodiment, the communication circuit 1030 or at least one antenna array may be positioned on or in the PCB 1050. For example, the first antenna array 1040 and/or the second antenna array 1045 may be positioned on a first surface of the PCB 1050, and the communication circuit 1030 may be positioned on a second surface of the PCB 1050. The PCB 1050 may include a coaxial cable connector or a board to board (B-to-B) connector for electrical connection with any other PCB (e.g., a PCB on which the communication module 950 of FIG. 9 is positioned) using a transmission line (e.g., the first conductive line 931 of FIG. 9 or a coaxial cable). The PCB 1050 may be connected with the PCB on which the communication module 950 is positioned, for example, using a coaxial cable, and the coaxial cable may be used to transmit a transmit/receive IF or RF signal. For another example, a power or any other control signal may be provided through the B-to-B connector.

According to an embodiment, the first antenna array 1040 and/or the second antenna array 1045 may include a plurality of antenna elements. The plurality of antenna elements may include a patch antenna or a dipole antenna. For example, the plurality of antenna elements may include dipole antennas having various structures described with reference to FIG. 3. For example, an antenna element included in the first antenna array 1040 may be a patch antenna for forming a beam toward a back plate of the electronic device 900. For another example, an antenna element included in the second antenna array 1045 may be a dipole antenna for forming a beam toward a side member of the electronic device 900.

According to an embodiment, the communication circuit 1030 may support a frequency band ranging from 24 GHz to 30 GHz or ranging from 37 GHz to 40 GHz. According to an embodiment, the communication circuit 1030 may up-convert or down-convert a frequency. For example, a communication circuit included in the communication device 921 may up-convert an IF signal received from the communication module 950 through the first conductive line 931. For another example, the communication circuit may down-convert a millimeter wave signal received through the first antenna array 1040 or the second antenna array 1045 included in the first communication device 921 and may transmit the down-converted signal to the communication module 950.

FIG. 11 is a block diagram of an electronic device in a network environment according to various embodiments.

Referring to FIG. 11, an electronic device 1101 (e.g., electronic device 100 of FIG. 1*b*) may communicate with an electronic device 1102 through a first network 1198 (e.g., a short-range wireless communication) or may communicate with an electronic device 1104 or a server 1108 through a second network 1199 (e.g., a long-distance wireless communication) in a network environment 1100. According to an embodiment, the electronic device 1101 may communicate with the electronic device 1104 through the server 1108. According to an embodiment, the electronic device 1101 may include a processor 1120, a memory 1130, an input device 1150, a sound output device 1155, a display device 1160, an audio module 1170, a sensor module 1176, an interface 1177, a haptic module 1179, a camera module 1180, a power management module 1188, a battery 1189, a communication module 1190, a subscriber identification module 1196, and an antenna module 1197. According to some embodiments, at least one (e.g., the display device 1160 or the camera module 1180) among components of the electronic device 1101 may be omitted or other components may be added to the electronic device 1101. According to some embodiments, some components may be integrated and implemented as in the case of the sensor module 1176 (e.g., a fingerprint sensor, an iris sensor, or an illuminance sensor) embedded in the display device 1160 (e.g., a display).

The processor 1120 may operate, for example, software (e.g., a program 1140) to control at least one of other components (e.g., a hardware or software component) of the electronic device 1101 connected to the processor 1120 and may process and compute a variety of data. The processor 1120 may load a command set or data, which is received from other components (e.g., the sensor module 1176 or the communication module 1190), into a volatile memory 1132, may process the loaded command or data, and may store result data into a nonvolatile memory 1134. According to an embodiment, the processor 1120 may include a main processor 1121 (e.g., a central processing unit or an application processor) and an auxiliary processor 1123 (e.g., a graphic processing device, an image signal processor, a sensor hub processor, or a communication processor), which operates independently from the main processor 1121, additionally or alternatively uses less power than the main processor 1121, or is specified to a designated function. In this case, the auxiliary processor 1123 may operate separately from the main processor 1121 or embedded.

In this case, the auxiliary processor 1123 may control, for example, at least some of functions or states associated with at least one component (e.g., the display device 1160, the sensor module 1176, or the communication module 1190) among the components of the electronic device 1101 instead of the main processor 1121 while the main processor 1121 is in an inactive (e.g., sleep) state or together with the main processor 1121 while the main processor 1121 is in an active (e.g., an application execution) state. According to an embodiment, the auxiliary processor 1123 (e.g., the image signal processor or the communication processor) may be implemented as a part of another component (e.g., the camera module 1180 or the communication module 1190) that is functionally related to the auxiliary processor 1123. The memory 1130 may store a variety of data used by at least one component (e.g., the processor 1120 or the sensor module 1176) of the electronic device 1101, for example, software (e.g., the program 1140) and input data or output data with respect to commands associated with the software. The memory 1130 may include the volatile memory 1132 or the nonvolatile memory 1134.

The program 1140 may be stored in the memory 1130 as software and may include, for example, an operating system 1142, a middleware 1144, or an application 1146.

The input device 1150 may be a device for receiving a command or data, which is used for a component (e.g., the processor 1120) of the electronic device 1101, from an outside (e.g., a user) of the electronic device 1101 and may include, for example, a microphone, a mouse, or a keyboard.

The sound output device 1155 may be a device for outputting a sound signal to the outside of the electronic device 1101 and may include, for example, a speaker used for general purposes, such as multimedia play or recordings play, and a receiver used only for receiving calls. According to an embodiment, the receiver and the speaker may be either integrally or separately implemented.

The display device 1160 may be a device for visually presenting information to the user of the electronic device 1101 and may include, for example, a display, a hologram device, or a projector and a control circuit for controlling a corresponding device. According to an embodiment, the display device 1160 may include a touch circuitry or a pressure sensor for measuring an intensity of pressure on the touch.

The audio module 1170 may convert a sound and an electrical signal in dual directions. According to an embodiment, the audio module 1170 may obtain the sound through the input device 1150 or may output the sound through an external electronic device (e.g., the electronic device 1102 (e.g., a speaker or a headphone)) wired or wirelessly connected to the sound output device 1155 or the electronic device 1101.

The sensor module 1176 may generate an electrical signal or a data value corresponding to an operating state (e.g., power or temperature) inside or an environmental state outside the electronic device 1101. The sensor module 1176 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 1177 may support a designated protocol wired or wirelessly connected to the external electronic device (e.g., the electronic device 1102). According to an embodiment, the interface 1177 may include, for example, an HDMI (high-definition multimedia interface), a USB (universal serial bus) interface, an SD card interface, or an audio interface.

A connecting terminal 1178 may include a connector that physically connects the electronic device 1101 to the external electronic device (e.g., the electronic device 1102), for example, an HDMI connector, a USB connector, an SD card connector, or an audio connector (e.g., a headphone connector).

The haptic module 1179 may convert an electrical signal to a mechanical stimulation (e.g., vibration or movement) or an electrical stimulation perceived by the user through tactile or kinesthetic sensations. The haptic module 1179 may include, for example, a motor, a piezoelectric element, or an electric stimulator.

The camera module 1180 may shoot a still image or a video image. According to an embodiment, the camera module 1180 may include, for example, at least one lens, an image sensor, an image signal processor, or a flash.

The power management module 1188 may be a module for managing power supplied to the electronic device 1101 and may serve as at least a part of a power management integrated circuit (PMIC).

The battery 1189 may be a device for supplying power to at least one component of the electronic device 1101 and may include, for example, a non-rechargeable (primary) battery, a rechargeable (secondary) battery, or a fuel cell.

The communication module 1190 may establish a wired or wireless communication channel between the electronic device 1101 and the external electronic device (e.g., the electronic device 1102, the electronic device 1104, or the server 1108) and support communication execution through the established communication channel. The communication module 1190 may include at least one communication processor operating independently from the processor 1120 (e.g., the application processor) and supporting the wired communication or the wireless communication. According to an embodiment, the communication module 1190 may include a wireless communication module 1192 (e.g., a cellular communication module, a short-range wireless communication module, or a GNSS (global navigation satellite system) communication module) or a wired communication module 1194 (e.g., an LAN (local area network) communication module or a power line communication module) and may communicate with the external electronic device using a corresponding communication module among them through the first network 1198 (e.g., the short-range communication network such as a Bluetooth, a WiFi direct, or an IrDA (infrared data association)) or the second network 1199 (e.g., the long-distance wireless communication network such as a cellular network, an internet, or a computer network (e.g., LAN or WAN)). The above-mentioned various communication modules 1190 may be implemented into one chip or into separate chips, respectively.

According to an embodiment, the wireless communication module 1192 may identify and authenticate the electronic device 1101 using user information stored in the subscriber identification module 1196 in the communication network.

The antenna module 1197 may include one or more antennas to transmit or receive the signal or power to or from an external source. According to an embodiment, the communication module 1190 (e.g., the wireless communication module 1192) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 1101 and the external electronic device 1104 through the server 1108 connected to the second network 1199. Each of the electronic devices 1102 and 1104 may be the same or different types as or from the electronic device 1101. According to an embodiment, all or some of the operations performed by the electronic device 1101 may be performed by another electronic device or a plurality of external electronic devices. When the electronic device 1101 performs some functions or services automatically or by request, the electronic device 1101 may request the external electronic device to perform at least some of the functions related to the functions or services, in addition to or instead of performing the functions or services by itself. The external electronic device receiving the request may carry out the requested function or the additional function and transmit the result to the electronic device 1101. The electronic device 1101 may provide the requested functions or services based on the received result as is or after additionally processing the received result. To this end, for example, a cloud computing, distributed computing, or client-server computing technology may be used.

According to an embodiment, an electronic device (e.g., the electronic device 100 of FIG. 1A) comprises a first conductive plate (e.g., the first antenna element 310 of FIG. 1A); a second conductive plate (e.g., the second antenna element 320 of FIG. 1A) spaced from the first conductive plate and positioned parallel to the first conductive plate; a conductive element (e.g., the third antenna element 210 and the fourth antenna element 220 of FIG. 1A) positioned in a space between the first conductive plate and the second conductive plate; a wireless communication circuit (e.g., the wireless communication circuit 105 of FIG. 1A) electrically connected with the first conductive plate and the conductive element; and a printed circuit board (e.g., the printed circuit board 110 of FIG. 1A) coupled with at least one side of the first conductive plate, at least one side of the second conductive plate, and one end of the conductive element, wherein the wireless communication circuit is configured to transmit/receive a first radio frequency (RF) signal having a vertical polarization characteristic using the first conductive plate and the second conductive plate and transmit/receive a second RF signal having a horizontal polarization characteristic using the conductive element.

Wherein, when viewed from above the first conductive plate, the first conductive plate, the second conductive plate, and the conductive element overlap each other at least partially.

The electronic device further comprises a first feed line (e.g., the first feed line 315 of FIG. 1A) electrically connected with a first feed part (e.g., the first feed part 313 of FIG. 1A) included in the first conductive plate, wherein the second conductive plate is electrically connected to a ground region of the printed circuit board.

Wherein the printed circuit board includes a cavity (e.g., the cavity 113 of FIG. 1A) for impedance mismatching.

Wherein the first feed line is extended from the wireless communication circuit to the first feed part through the cavity, wherein a first distance (e.g., the distance 316 of FIG. 4A) from a first side of the first conductive plate, which is coupled with the printed circuit board, to the first feed part and a second distance (e.g., the distance 115 of FIG. 5) corresponding to a longitudinal length of the cavity, which is parallel to the second feed line, are associated with impedance matching.

Wherein the first conductive plate includes a first side (e.g., the first side 310*a* of FIG. 4A) coupled with the printed circuit board and a second side (e.g., the second side 310*b* of FIG. 4A) facing away from the first side, wherein the wireless communication circuit is configured to transmit/receive the first RF signal in a frequency band corresponding to a distance between the second side and the first feed part.

Wherein the first conductive plate includes a first side coupled with the printed circuit board, a second side facing away from the first side, and a third side (e.g., the third side 310*c* of FIG. 4A) and a fourth side (e.g., the fourth side 310*d* of FIG. 4A) connecting opposite ends of the first side and opposite ends of the second side, wherein the wireless communication circuit is configured to transmit/receive the first RF signal having a bandwidth corresponding to a distance between the third side and the fourth side.

Wherein the first conductive plate includes at least one slit (e.g., the slits 331, 333, 335, 337 of FIGS. 4B and 4C) extended from the second side, the third side, or the fourth side, and wherein the wireless communication circuit is configured to transmit/receive the first RF signal having the bandwidth formed by the distance between the third side and the fourth side and the at least one slit.

Wherein the conductive element (e.g., the antenna element 205 of FIG. 5) includes a first portion (e.g., the first portion 205*a* of FIG. 5) extended from the printed circuit board and a second portion (e.g., the second portion 205*b* of FIG. 5) perpendicular to the first portion, wherein the electronic device further comprises a second feed line (e.g., the second feed line 211 of FIGS. 1A and 5) electrically connected with a second feed part included in the second portion and extending in parallel with the first portion, and wherein one end of the first portion is electrically connected to a ground region of the printed circuit board.

Wherein the first portion extends in parallel with the second feed line with a first gap, and wherein the first gap and a distance (e.g., the distance 231 of FIG. 5) from the one end of the first portion, which is coupled with the printed circuit board, to the second feed part are associated with impedance matching.

Wherein the wireless communication circuit is configured to transmit/receive the second RF signal having a bandwidth corresponding to a thickness (e.g., the thickness 235 of FIG. 5) of the second portion.

Wherein the wireless communication circuit is configured to transmit/receive the second RF signal in a frequency band corresponding to a length of a vertical edge of the second portion (e.g., the length of a vertical edge 234 of FIG. 5) and a length of a horizontal edge of the second portion (e.g., the length of a horizontal edge 233 of FIG. 5).

Wherein the first conductive plate has a first distance (e.g., the first distance 311-1, 311-2, 311-3 of FIG. 6) from one end of the first conductive plate, which is coupled with the printed circuit board, to an opposite end of the first conductive plate, wherein the second conductive plate has a second distance (e.g., the first distance 321-1, 321-2, 321-3 of FIG. 6) from one end of the second conductive plate, which is coupled with the printed circuit board, to an opposite end of the second conductive plate, and wherein the wireless communication circuit is configured to transmit/receive the first RF signal and the second RF signal having a directivity formed according to a difference between the first distance and the second distance.

According to an embodiment, an electronic device (e.g., the electronic device 100 of FIG. 1A) comprises a housing including a front plate (e.g., the front plate 120 of FIG. 1B), a back plate (e.g., the back plate 140 of FIG. 1B) facing away from the front plate, and a side member (e.g., the side member 125 of FIG. 1B) surrounding a space between the front plate and the back plate; a touchscreen display exposed through the front plate; an antenna array (e.g., the antenna array 510, 520 of FIG. 8A) positioned in the space. Wherein the antenna array includes at least one group, wherein the at least one group includes: a first conductive plate (e.g., the first antenna element 310 of FIG. 1A) positioned parallel to the back plate and spaced from the back plate as much as a first distance; a pair of conductive elements (e.g., the third and fourth antenna element 210, 220 of FIG. 1A) spaced from the first conductive plate when viewed from above the back plate and positioned parallel to the back plate, wherein the pair of conductive elements includes: a first conductive element (e.g., the third antenna element 210 of FIG. 1A) spaced from the back plate as much as a second distance greater than the first distance; and a second conductive element (e.g., the fourth antenna element 220, 220 of FIG. 1A) spaced from the back plate as much as the second distance or a third distance greater than the second distance; and a second conductive plate (e.g., the second antenna element 320 of FIG. 1A) interposed between the first conductive plate and the front plate, positioned parallel to the back plate, and spaced from the back plate as much as a fourth distance greater than the third distance; a wireless communication circuit (e.g., the wireless communication circuit 105 of FIG. 1A) electrically connected with the first conductive plate and the first conductive element or the second conductive element; and a processor (e.g., the processor 940 of FIG. 9) electrically connected to the display and the wireless communication circuit, wherein the wireless communication circuit is configured to transmit/receive a signal in a frequency band of 20 GHz or higher.

Wherein the antenna array includes: a plurality of groups of the first conductive plate, the pair of conductive elements, and the second conductive plate aligned along the side member when viewed from above the back plate.

Wherein the first conductive element is electrically connected with a ground.

Wherein the pair of conductive elements functions as a dipole antenna.

Wherein the first conductive plate has a first size, the second conductive plate has a second size larger than the first size, and the first conductive element has a third size smaller than the first size.

Wherein the second conductive plate includes a plurality of portions (e.g., the conductive patterns 427, 429 of FIG. 7) electrically separated from each other; and at least one switching element (e.g., the switching element 455, 457 of FIG. 7) configured to electrically connect the plurality of portions selectively.

Wherein the pair of conductive elements extends between the first conductive plate and the second conductive plate.

The electronic device according to various embodiments disclosed in the present disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the present disclosure should not be limited to the above-mentioned devices.

It should be understood that various embodiments of the present disclosure and terms used in the embodiments do not intend to limit technologies disclosed in the present disclosure to the particular forms disclosed herein; rather, the present disclosure should be construed to cover various modifications, equivalents, and/or alternatives of embodiments of the present disclosure. With regard to description of drawings, similar components may be assigned with similar reference numerals. As used herein, singular forms may include plural forms as well unless the context clearly indicates otherwise. In the present disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the present disclosure may be implemented by software (e.g., the program 1140) including an instruction stored in a machine-readable storage media (e.g., an internal memory 1136 or an external memory 1138) readable by a machine (e.g., a computer). The machine may be a device that calls the instruction from the machine-readable storage media and operates depending on the called instruction and may include the electronic device (e.g., the electronic device 1101). When the instruction is executed by the processor (e.g., the processor 1120), the processor may perform a function corresponding to the instruction directly or using other components under the control of the processor. The instruction may include a code generated or executed by a compiler or an interpreter. The machine-readable storage media may be provided in the form of non-transitory storage media. Here, the term "non-transitory", as used herein, is a limitation of the medium itself.

According to an embodiment, the method according to various embodiments disclosed in the present disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the present disclosure may be executed sequentially, in parallel, repeatedly, or in a heuristic method. Also, at least some operations may be executed in different sequences, omitted, or other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a printed circuit board (PCB);

a patch antenna comprising a first conductive plate and a second conductive plate spaced from the first conductive plate and disposed parallel to the first conductive plate;

a dipole antenna including conductive elements disposed in a space between the first conductive plate and the second conductive plate; and a wireless communication circuit disposed on the PCB and electrically connected with the patch antenna and the conductive elements; and wherein the wireless communication circuit is configured to:

transmit/receive a first radio frequency (RF) signal having a vertical polarization characteristic using the patch antenna and transmit/receive a second RF signal having a horizontal polarization characteristic using the dipole antenna.

2. The electronic device of claim 1, wherein the first conductive plate, the second conductive plate, and the conductive elements at least partially overlap each other in plan view.

3. The electronic device of claim 1, further comprising:

a first feed line electrically connected with a first feed included in the first conductive plate, wherein the second conductive plate is electrically connected to a ground region of the PCB.

4. The electronic device of claim 3, wherein the PCB includes a cavity configured to provide impedance mismatching.

5. The electronic device of claim 4, wherein the first feed line extends from the wireless communication circuit to the first feed of the first conductive plate through the cavity, wherein a first distance from a first side of the first conductive plate, which is coupled with the PCB, to the first feed and a second distance corresponding to a longitudinal length of the cavity, which is parallel to a second feed line electrically connected to the conductive elements, are associated with impedance matching.

6. The electronic device of claim 3, wherein the first conductive plate includes a first side coupled with the PCB and a second side facing a direction opposite the first side, wherein a frequency band of the first RF signal is based on a distance between the second side and the first feed.

7. The electronic device of claim 3, wherein the first conductive plate includes a first side coupled with the PCB, a second side facing a direction opposite the first side, and a third side and a fourth side connecting opposite ends of the first side and opposite ends of the second side, wherein a bandwidth of the first RF signal is based on a distance between the third side and the fourth side.

8. The electronic device of claim 7, wherein the first conductive plate includes at least one slit extending from the second side, the third side, or the fourth side, and wherein the bandwidth is based on a distance between the third side and the fourth side and the at least one slit.

9. The electronic device of claim 1, wherein the conductive elements include a first conductive element including a first portion extending from the PCB and a second portion perpendicular to the first portion, wherein the conductive elements further comprise:

a feed line electrically connected with a feed included in the second portion and extending in parallel with the first portion, and wherein one end of the first portion is electrically connected to a ground region of the PCB.

10. The electronic device of claim 9, wherein the first portion extends in parallel with the feed line with a first gap therebetween, and wherein the first gap and a distance from the one end of the first portion, which is coupled with the PCB, to the feed are associated with impedance matching.

11. The electronic device of claim 9, wherein a bandwidth of the second RF signal is based on a thickness of the second portion.

12. The electronic device of claim 9, wherein a frequency band of the second RF signal is based on a length of a vertical edge of the second portion and a length of a horizontal edge of the second portion.

13. The electronic device of claim 1, wherein a first distance is based on a distance from one end of the first conductive plate, which is coupled with the PCB, to an opposite end of the first conductive plate, wherein a second distance is based on a distance from one end of the second conductive plate, which is coupled with the PCB, to an opposite end of the second conductive plate, and wherein the first RF signal and the second RF signal have a directivity based on a difference between the first distance and the second distance.

14. The electronic device of claim 1, wherein the PCB is coupled with at least one side of the first conductive plate, at least one side of the second conductive plate, and one end of the conductive elements.

* * * * *